US006799386B2

(12) United States Patent
Robinson et al.

(10) Patent No.: US 6,799,386 B2
(45) Date of Patent: Oct. 5, 2004

(54) EXCAVATING TOOTH POINT/ADAPTER ASSEMBLY

(75) Inventors: Howard W. Robinson, Grapevine, TX (US); Wayne A. Shamblin, Burleson, TX (US); Bruce L. Hart, Garland, TX (US)

(73) Assignee: Hensley Industries, Inc., Dallas, TX (US)

( * ) Notice: Subject to any disclaimer, the term of this patent is extended or adjusted under 35 U.S.C. 154(b) by 0 days.

(21) Appl. No.: 10/721,679

(22) Filed: Nov. 25, 2003

(65) Prior Publication Data

US 2004/0103566 A1 Jun. 3, 2004

Related U.S. Application Data

(62) Division of application No. 10/005,935, filed on Dec. 3, 2001, now Pat. No. 6,708,431.

(51) Int. Cl.[7] ..... E02F 9/28
(52) U.S. Cl. ..... 37/452
(58) Field of Search ..... 37/446, 449, 452, 37/451, 453–460; 172/701.1–701.3; 403/150, 153, 297, 355; 299/109, 111, 113

(56) References Cited

U.S. PATENT DOCUMENTS

| | | | | |
|---|---|---|---|---|
| 2,904,909 | A | 9/1959 | Ratkowski | 37/142 |
| 3,406,471 | A | 10/1968 | Duplessis | 37/142 |
| 3,740,876 | A | 6/1973 | Solokhin et al. | 37/142 A |
| 3,997,989 | A | 12/1976 | Stepe | 37/142 A |
| 4,067,657 | A | 1/1978 | Kaarlela | 403/317 |
| 4,096,653 | A | 6/1978 | Kaarlela et al. | 37/142 A |
| 4,918,843 | A | 4/1990 | Kiesewetter | 37/142 A |
| 4,919,566 | A | 4/1990 | Caron et al. | 404/121 |
| 5,435,084 | A | 7/1995 | Immel | 37/398 |
| 5,702,112 | A | 12/1997 | Brannstrom | 279/19 |
| 5,765,301 | A | 6/1998 | Clendenning | 37/457 |
| 5,913,605 | A | 6/1999 | Jusselin et al. | 37/451 |
| 5,937,550 | A | 8/1999 | Emerich | 37/458 |
| 5,956,874 | A | 9/1999 | Ianello et al. | 37/456 |
| 5,987,787 | A | 11/1999 | Mack | 37/456 |
| 5,992,063 | A | 11/1999 | Mack | 37/450 |
| 6,053,655 | A | 4/2000 | Mazhar | 403/320 |
| 6,079,132 | A | 6/2000 | Clendenning | 37/457 |
| 6,092,958 | A | 7/2000 | Gale | 403/378 |
| 6,119,378 | A | 9/2000 | Pippins | 37/454 |
| 6,393,739 | B1 | 5/2002 | Shamblin et al. | 37/456 |
| 2001/0001352 | A1 | 5/2001 | Munoz et al. | 37/455 |

FOREIGN PATENT DOCUMENTS

| | | |
|---|---|---|
| EP | 1 096 073 A1 | 2/2001 |
| WO | WO 02/04750 A1 | 1/2002 |

OTHER PUBLICATIONS

EPO Patent Abstract of Japan, Publication No. 102 52106—Sep. 1998.

*Primary Examiner*—Robert E Pezzuto
(74) *Attorney, Agent, or Firm*—Konneker & Smith, P.C.

(57) ABSTRACT

A rotatable connector pin assembly is disposed within an opening in an adapter nose, with opposite ends of the pin portion of the assembly extending outwardly beyond opposite sides of the adapter nose in axially fixed orientations relative thereto, and is used to captively and releasably retain a replaceable excavating tooth point on the nose. The configuration of the opposite pin ends permits the overall pin assembly to remain in the adapter nose during removal of the point and replacement thereof, with the pin being rotatable between a first orientation in which its ends permit removal of a point from the nose, or installation of a point on the nose, and a second orientation in which the opposite pin ends block removal of the point from the adapter nose.

35 Claims, 19 Drawing Sheets

EXCAVATING TOOTH POINT/ADAPTER ASSEMBLY

CROSS-REFERENCE TO RELATED APPLICATION

This application is a division of copending U.S. application Ser. No. 10/005,935 filed on Dec. 3, 2001 now U.S. Pat. No. 6,708,431 and entitled "EXCAVATING TOOTH ASSEMBLY WITH ROTATABLE CONNECTOR PIN STRUCTURE".

BACKGROUND OF THE INVENTION

The present invention generally relates to material displacement apparatus and, in a preferred embodiment thereof, more particularly relates to apparatus for releasably coupling a replaceable excavating tooth point or other wear member to an associated adapter nose structure.

A variety of types of material displacement apparatus are provided with replaceable wear portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, generally aligned transverse openings are formed through these interchangeable elements adjacent the rear end of the point, and a suitable connector structure is driven into and forcibly retained within the aligned openings to releasably anchor the replaceable tooth point on its associated adapter nose portion.

The connector structure typically has to be forcibly driven into the aligned tooth point and adapter nose openings using, for example, a sledge hammer. Subsequently, the inserted connector structure has to be forcibly pounded out of the point and nose openings to permit the worn point to be removed from the adapter nose and replaced. This conventional need to pound in and later pound out the connector structure can easily give rise to a safety hazard for the installing and removing personnel.

Various alternatives to pound-in connector structures have been previously proposed for use in releasably retaining a replaceable wear member, such as a tooth point, on a support structure such as an adapter nose. While these alternative connector structures desirably eliminate the need to pound a connector structure into and out of an adapter nose they typically present various other types of problems, limitations and disadvantages including, but not limited to, complexity of construction and use, undesirably high cost, and the necessity of removing the connector structure prior to removal or installation of the replaceable wear member.

A need accordingly exists for an improved wear member/support member connector structure. It is to this need that the present invention is directed.

SUMMARY OF THE INVENTION

In carrying out principles of the present invention, in accordance with a preferred embodiment thereof, specially designed excavating apparatus is provided which comprises a support structure having a forwardly projecting portion, a hollow wear member removably mountable on the forwardly projecting support structure portion to shield it from operational wear, and a rotatable connector pin assembly which is removably received in an opening in the forwardly projecting support structure portion and includes a connector pin having a longitudinal portion extending laterally outwardly from the forwardly projecting support structure portion.

The wear member, which is representatively a replaceable excavating tooth point, is rearwardly telescopable onto the forwardly projecting support structure portion, which is representatively an adapter nose, past the outwardly extending longitudinal pin portion which moves forwardly into a rear end cavity portion of the tooth point in a release/installation rotational position. With the point in place on the adapter nose, the connector pin is rotated relative to the adapter nose, without causing the pin to axially move relative thereto, to a locking rotational position thereof in which the outwardly extending longitudinal portion of the pin, illustratively both of its opposite ends, blocks removal of the tooth point. Representatively, the support structure and the wear member have opposing, alternately scalloped curved forwardly and rearwardly facing surfaces which are configured and positioned to be complementarily interlocked when the wear member is operatively mounted on the support structure.

When it is desired to remove the point, the connector pin is rotated away from its locking position to its release/installation position, still without moving the pin axially relative to the adapter nose, to terminate the blocking relationship between the outwardly extending longitudinal pin portion and the point and permit the forward removal of the tooth point from the adapter nose. Thus, a tooth point can be removed from or installed on the adapter nose without removing the connector pin assembly from the adapter nose or axially retracting or extending the outwardly projecting opposite pin ends relative to the adapter.

In a first illustrated embodiment of the overall tooth point/adapter assembly (an illustrative wear member/support structure assembly) the tooth point has spaced apart front and rear ends, a cavity extending forwardly through the rear end and configured to removably and complementarily receive the adapter nose, which representatively has a horizontally elongated elliptical cross-section, and an exterior side wall extending forwardly from the rear end and partially bounding the cavity. A recess is formed in the interior side surface of the point side wall, the recess having a first end portion opening outwardly through the rear end of the tooth point, and a second end portion disposed forwardly of the first end portion of the recess and being enlarged relative thereto in a direction parallel to the interior side surface of the exterior side wall of the point.

The previously mentioned connector pin is rotatably supported in a transverse opening in the adapter nose, in a manner preventing the pin from axially moving in response to rotation thereof, and has a longitudinal portion (representatively its opposite ends) extending outwardly from an exterior surface portion of the adapter nose. With the connector pin in a release/installation rotational position thereof the point is rearwardly telescoped onto the adapter nose in a manner causing the outwardly extending longitudinal pin portion, representatively axially offset opposite pin end tab portions, to pass forwardly into the interior point recess area. When the point is in place on the adapter nose, the connector pin is rotated to a locking rotational position thereof to thereby cause the outwardly extending longitudinal pin portion to block the forward removal of the tooth point from the adapter nose. By rotating the pin back to its release position, the point can be moved forwardly off the adapter nose with the pin still in place within the adapter nose and still projecting outwardly therefrom.

In one embodiment thereof, the connector pin assembly includes the connector pin and a hollow cartridge which rotatable receives the connector pin and is itself nonrotatably received in the adapter nose opening. Representatively, the adapter nose opening and the cartridge have complementarily noncircular cross-sections. First cooperating structures are associated with the connector pin and the cartridge and function to permit rotation of the connector pin relative to the cartridge about the pin axis, but preclude appreciable axial movement of the connector pin relative to the cartridge. Representatively, these first cooperating structures include a circumferential exterior side surface groove formed in a longitudinally intermediate portion of the pin, and a set screw extending inwardly through a side of the cartridge and slidingly received in the groove.

Preferably, second cooperating structures are also associated with the cartridge and the connector pin and function as a detent mechanism which is operable to releasably hold the connector pin in either selected one of its rotational locking and release/installation positions. Illustratively, this detent mechanism includes first and second spaced apart recesses formed in one of the cartridge and the connector pin, and a resiliently depressible detent structure carried by the other of the cartridge and the connector pin member and being releasably receivable in a selectively variable one of the first and second spaced apart recesses.

A second representatively illustrated embodiment of the tooth point/adapter assembly is similar to the first described embodiment with the exceptions that (1) a locking member is rotatably carried by the tooth point in the inner portion of the interior point recess, and (2) the outwardly extending longitudinal portion of the connector pin is configured to interlock with the locking member, and be rotatable therewith, in response to mounting of the tooth point on the adapter nose and corresponding forward movement of the outwardly extending longitudinal pin portion through the tooth point recess. When the point is in place on the adapter nose, the locking member is rotated to rotationally drive the pin to its locking position and thereby cause the outwardly extending longitudinal pin portion to interact with the locking member in a manner blocking the rearward removal of the longitudinal pin portion from the locking member and thus blocking the forward removal of the point from the adapter nose.

In a third representative embodiment of the tooth point/adapter assembly, the tooth point interior side surface recess is eliminated and replaced with a locking lug disposed on and projecting inwardly from an interior side surface of the point rearwardly of a connector opening therein, and the outwardly extending longitudinal connector pin portion has a slot therein. With the connector pin in its release/installation rotational position, the tooth point is rearwardly moved onto the adapter nose to thereby cause the point lug to pass rearwardly through and beyond the connector pin slot. The connector pin is then rotated to its locking rotational position to thereby cause its outwardly extending longitudinal portion to forwardly block the point lug and prevent the point from being forwardly removed from the adapter nose. When it is desired to remove the point from the adapter nose, the connector pin is simply rotated back to its release rotational position, and the point is forwardly removed from the adapter nose, with the point lug passing forwardly through the connector pin slot during such removal.

In a first alternate embodiment of the connector pin assembly the first cooperating structures, which permit the connector pin to be rotated relative to the cartridge without appreciable axial movement of the connector pin relative to the cartridge, include a dowel member extending through a transverse threaded hole in the cartridge, and a circumferentially extending exterior side surface groove formed on the connector pin and slidably receiving an inner end portion of the dowel. The dowel is captively retained in the cartridge by a set screw threaded into the dowel opening outwardly of the dowel.

The detent structure in this connector pin assembly embodiment includes a spring plunger transversely threaded into the cartridge and having a resiliently depressible inner end portion received in a second circumferentially extending exterior side surface groove formed on the connector pin and having depressions at its outer ends. The depressible end portion of the spring plunger is caused to snap into these openings as the connector pin is rotated to its first and second rotational detent positions.

In a second alternate embodiment of the connector pin assembly, appreciable axial movement of the rotatable connector pin relative to the cartridge is precluded by a transverse dowel carried by the cartridge and having an inner end portion slidably received in a circumferentially extending exterior side surface groove formed in the connector pin and having transverse opposite end portions extending in a first direction parallel to the length of the connector pin.

The detent structure which releasably retains the connector pin in its first and second rotational limit positions includes the dowel and a spring-loaded locking rod slidably carried within a longitudinally extending cartridge bore laterally offset from the connector pin and having an outer end portion projecting outwardly beyond an end of the cartridge. The locking rod is longitudinally movable relative to the cartridge between first and second limit positions, and is spring-biased in an outward longitudinal direction relative to the cartridge. The dowel is transversely carried by the locking rod for movement therewith.

With the connector pin in either of its two rotational detent positions the inner end portion of the dowel is received in one of the transverse connector pin groove end portions and is thereby releasably locked in one of the pin's detent positions. To release the pin the locking rod is depressed into the cartridge to move the dowel into alignment with the pin groove portion extending between its opposite transverse end portions. With the locking rod still depressed, the pin is rotated to align its opposite transverse groove end portion with the inner end portion of the dowel. The locking rod is then released to thereby resiliently drive it back to its starting position which drives the dowel into the adjacent transverse pin groove end portion and releasably lock the connector pin in its second rotational detent position.

In a third alternate embodiment of the connector pin assembly, the first cooperating structures which preclude appreciable axial movement of the connector pin relative to the cartridge, but permit the connector pin to be rotated between its two rotational positions relative to the cartridge include a dowel extending through a threaded transverse cartridge bore and slidably received in a circumferentially extending exterior side surface groove in the connector pin, the dowel being captively retained in the cartridge by a set screw threadingly received in the transverse cartridge bore outwardly of the dowel.

The detent structure which is operative to releasably lock the connector pin in either of its two rotational limit positions relative to the cartridge includes a spring plunger threadingly received in a transverse bore in the connector pin and having a depressible end portion projecting outwardly beyond an outer side portion of the connector pin, and a circumferentially spaced pair of depressions formed in the interior side surface of the cartridge. When the connector pin is rotated to either of its limit positions the resiliently depressible end portion of the spring plunger snaps into one of these cartridge interior side surface depressions.

DETAILED DESCRIPTION

Figure 1:
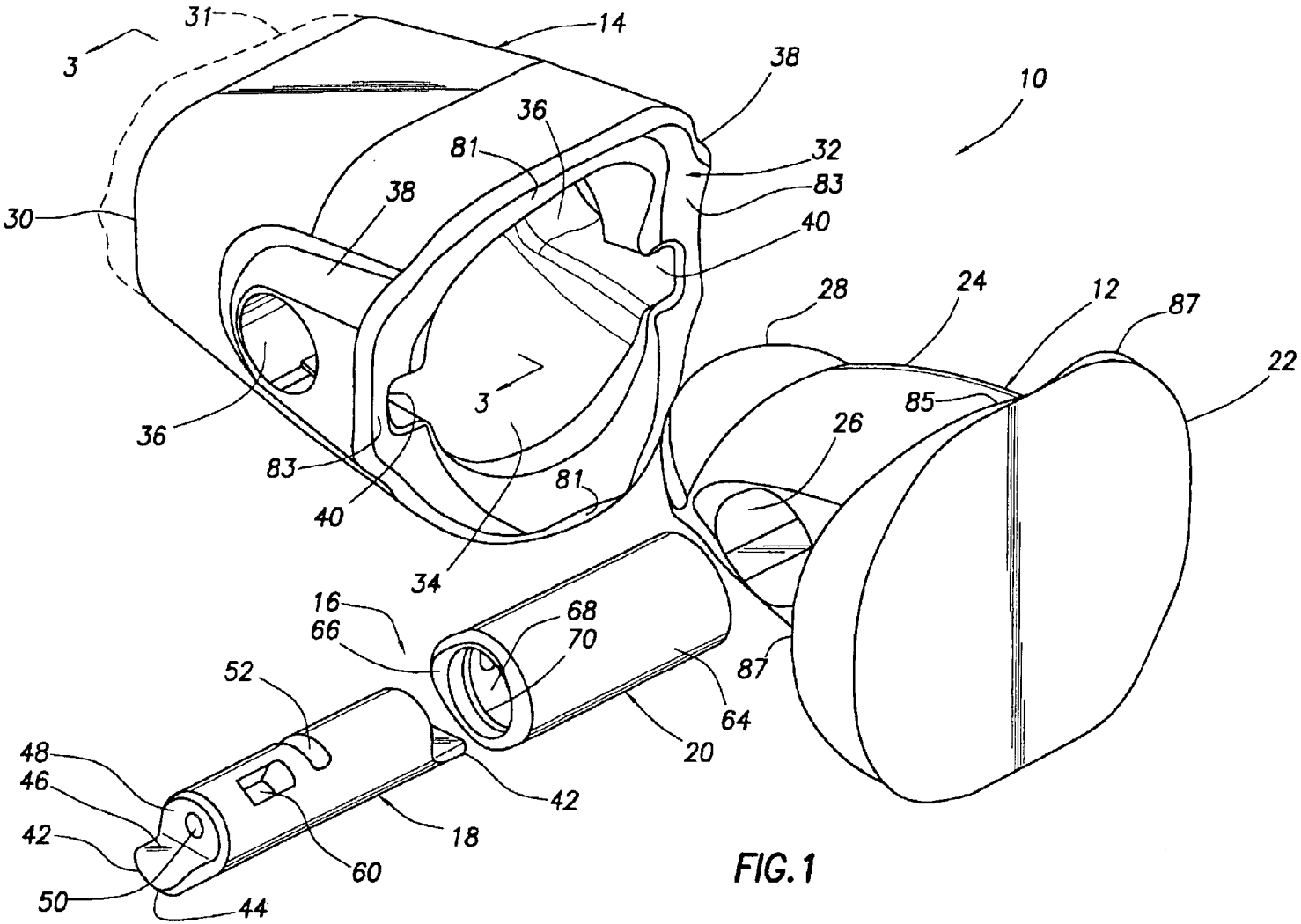
FIG. 1 is an exploded perspective view of an excavating tooth assembly embodying principles of the present invention.

Referring initially to FIGS. 1–7, in a first embodiment thereof this invention provides an excavating tooth assembly 10 including a support structure representatively in the form of an adapter 12, a wear member representatively in the form of a replaceable tooth point 14, and a rotatable connector pin assembly 16 having a pin portion 18 and a hollow body or cartridge portion 20.

Adapter 12 has a rear base portion 22 from which a nose portion 24 forwardly projects, the nose portion 24 having a horizontally elongated elliptical cross-section along its length, and a non-circular transverse connector opening 26 extending horizontally therethrough between the opposite vertical sides of the nose 24.

The replaceable point 14 has a front end 30 on which a suitable leading edge 31 (a portion of which is shown in phantom) is disposed, a rear end 32 through which a nose-receiving socket 34 forwardly extends, and a horizontally opposed pair of horizontally elongated elliptical connector openings 36 extending inwardly through thickened external boss portions 38 into the interior of the socket 34. The interior surface of the socket 34 has a configuration substantially complementary to the external surface of the adapter nose 24. A horizontally opposed pair of generally rectangular recesses 40 are formed in interior vertical side wall surface portions of the point 14 and extend forwardly through the rear end 32 of the point 14. As may be best seen in FIG. 3, each of these recesses 40 has a height less than the heights of the point side wall openings 36, and forwardly terminates at a bottom portion of one of such openings 36. Thus, each recess 40 has a front or inner end portion which is defined by a side surface of an associated opening 36 and is enlarged relative to a rear or outer end portion of the recess 40 in a direction parallel to the inner side surface of the tooth point side wall in which the recess 40 is formed.

Figure 4:
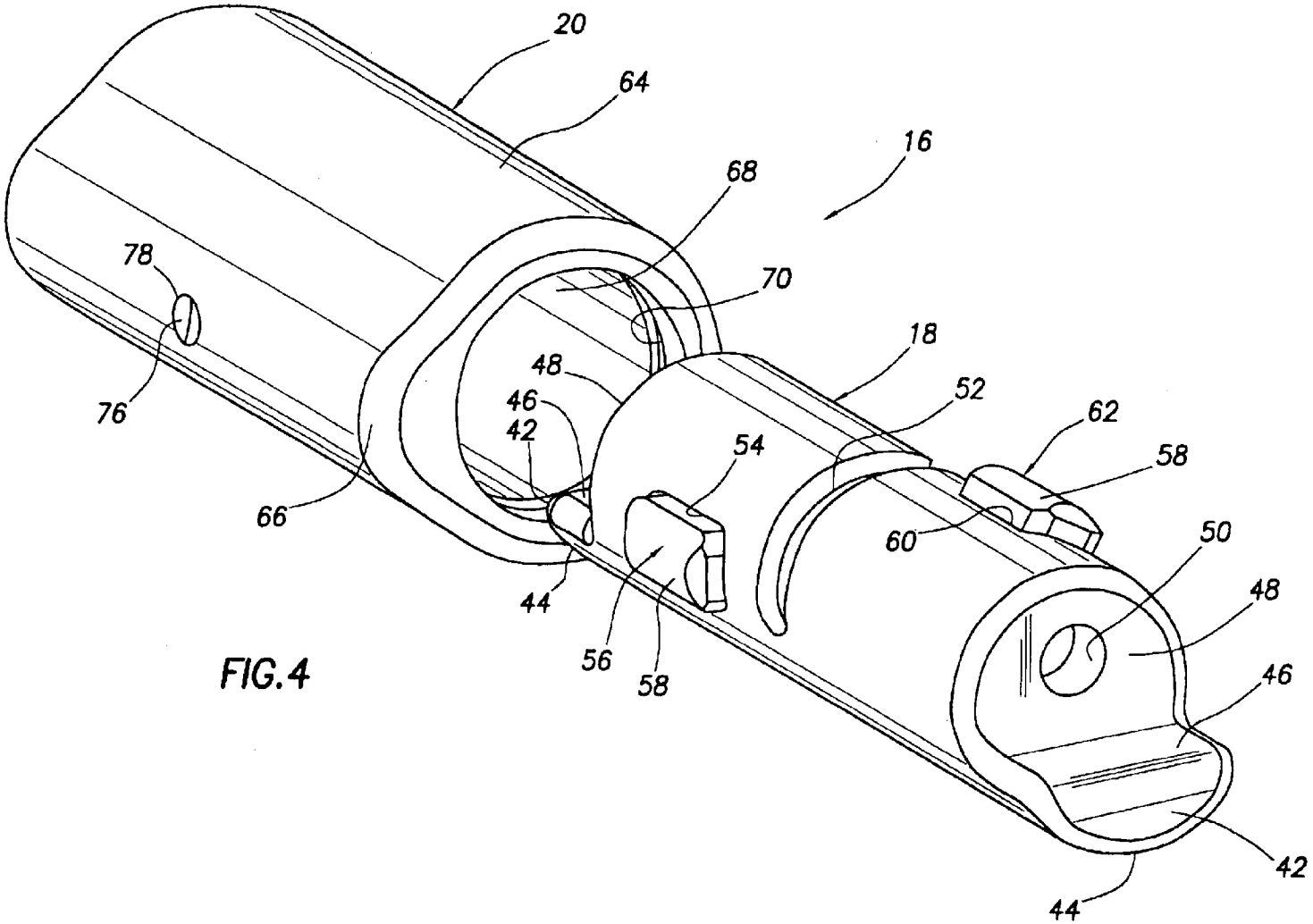
FIG. 4 is an enlarged scale partially exploded perspective view of a rotatable connector pin assembly portion of the overall excavating tooth assembly.

With reference now to FIGS. 1 and 4, the pin portion 18 of the connector pin assembly 16 has an elongated cylindrical configuration with outwardly projecting end tabs 42 disposed on its opposite ends. Each tab 42 has an arcuate laterally outer side surface 44 which is a continuation of a curved side surface portion of the cylindrical pin body, and an opposing, generally planar laterally inner side surface 46 which extends generally chordwise of the pin body. Each tab 42 longitudinally terminates at a flat end surface 48 of the pin 18, with a circular opening 50 extending inwardly through each flat end surface 48 in a laterally offset relationship with the longitudinal axis of the pin 18.

A circumferentially extending exterior side surface groove 52 is formed on a longitudinally central portion of the pin 18, the groove 52 representatively extending through an arc of 120 degrees. On one side of the groove 52, adjacent a first one of its ends, is an external side surface recess 54 that receives an outwardly projecting detent structure 56 which may be resiliently depressed inwardly into the recess 54. Representatively, the detent structure 56 is formed from an outer metal portion 58 and an inner resilient portion (not visible). On the other side of the groove 52, adjacent the other one of its ends, is another external side surface recess 60 which receives a second .outwardly projecting detent structure 62 identical in construction to the detent structure 56.

Figure 5:
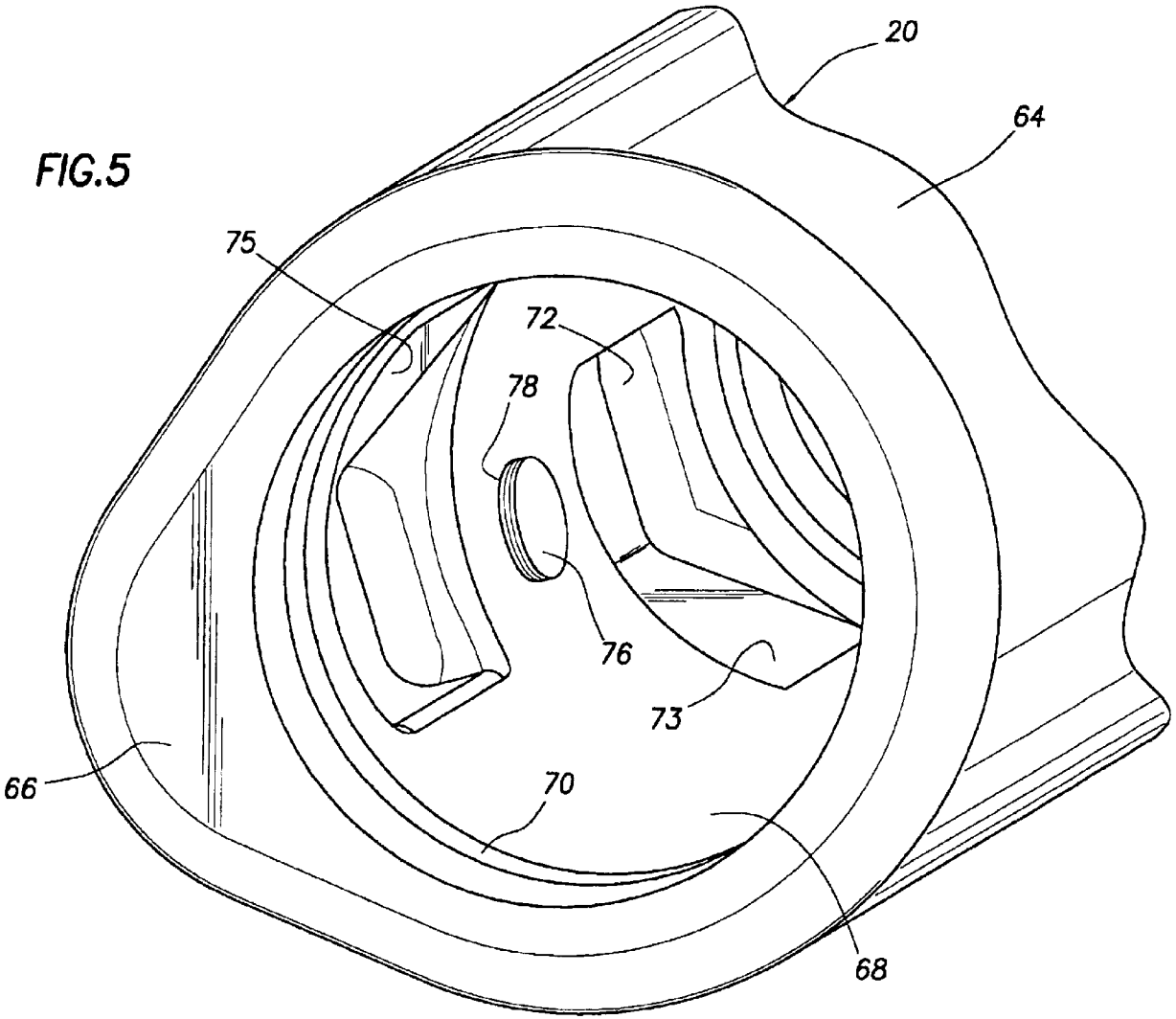
FIG. 5 is an enlarged scale perspective view of an end of a cartridge portion of the connector pin assembly.

Turning now to FIGS. 1, 4 and 5, the cartridge portion 20 of the connector pin assembly 16 has a noncircular outer side surface configuration disposed on an elongated, generally tubular body 64 having a generally triangular outwardly projecting lobe portion 66 extending along one side thereof. The nose opening 26 has an interior surface configuration complementary to the external side surface configuration of the cartridge body 64 and dimensioned to permit the cartridge 20 to be slidably but nonrotatably received in the nose opening 26.

A circular bore 68, sized to slidably and rotatably receive the pin 18, extends longitudinally through the cartridge body 64 and opens outwardly through its opposite ends. Suitable annular seals 70 are interiorly disposed in opposite end portions of the bore 68 and serve to inhibit the entry of fines into the interior of the cartridge 20 when the pin 18 is rotatably received therein. As best illustrated in FIG. 5, a circumferentially aligned pair of longitudinally spaced recesses 72,74 are formed in the interior side surface of the bore 68. Recesses 72,74 respectively have circumferentially ramped side surfaces 73 and 75. A set screw 76 (see also FIG. 4) extends radially inwardly through a threaded opening 78 in the cartridge lobe 66 and is selectively advanceable into and retractable outwardly from the interior of the bore 68.

The connector pin assembly 16 is assembled by inserting the pin 18 into the bore 68 of the cartridge body 64 until the external pin groove 52 is aligned with the retracted set screw 76. The set screw 76 is then threadingly advanced into the pin groove 52 to thereby prevent the installed pin 18 from moving axially relative to the cartridge 20. With the pin 18 captively retained within the cartridge 20 in this manner, the pin 18 may be rotated through an arc of 120 degrees relative to the cartridge 20, with the opposite ends of the pin groove 52 serving as abutments for the set screw 76 to limit the rotation of the pin 18 to 120 degrees relative to the cartridge 20. (Of course, this angle could be of another magnitude if desired).

When the pin 18 is at one end of this arc the pin detent 56 is snapped into the interior cartridge recess 72, and the pin detent 62 is resiliently pressed into its associated pin recess 60 by a nonrecessed interior side surface portion of the bore 68. When the pin 18 is rotated to the other end of this arc, the pin detent 62 snaps into the interior cartridge recess 74, and the other pin detent 56 is rotated out of its associated interior cartridge recess 74 and resiliently pressed into its pin recess 54 by a nonrecessed interior side surface portion of the circular bore 68.

With the pin assembly 16 in this assembled state, the cartridge 20 is inserted into the complementarily configured noncircular adapter nose opening 26 which prevents the inserted cartridge 20 from rotating relative to the adapter nose 24. After the pin assembly 16 has been installed in this manner, the opposite ends of the cartridge 20 are generally flush with the opposite vertical sides of the nose 24, and the pin tabs 42 project outwardly from such vertical nose sides. The pin tabs 42 define a longitudinal portion of the connector pin 18 which extends outwardly beyond opposite exterior side surface portions of the adapter nose 24. While opposite end portion of the pin 18 are used to releasably lock the point 14 on the adapter nose 24, it will be readily appreciated by those of ordinary skill in this particular art that only one pin could be used for this function if desired, such single pin end also defining an outwardly extending longitudinal portion of the connector pin.

To ready the installed pin assembly 16 for its role in captively retaining the point 14 on the adapter nose 24, the pin 18 is rotated relative to the cartridge 20 in a manner such that, as indicated in FIGS. 1 and 4, the flat top sides 46 of the pin tabs 42 face upwardly. In this rotational orientation of the tabs 42 the pin detent 56 is snapped into its associated interior cartridge recess 72. As can be seen in FIG. 1, with the tabs 42 in this orientation they can pass forwardly through the interior side surface recesses 40 in the point 14.

Figure 6:
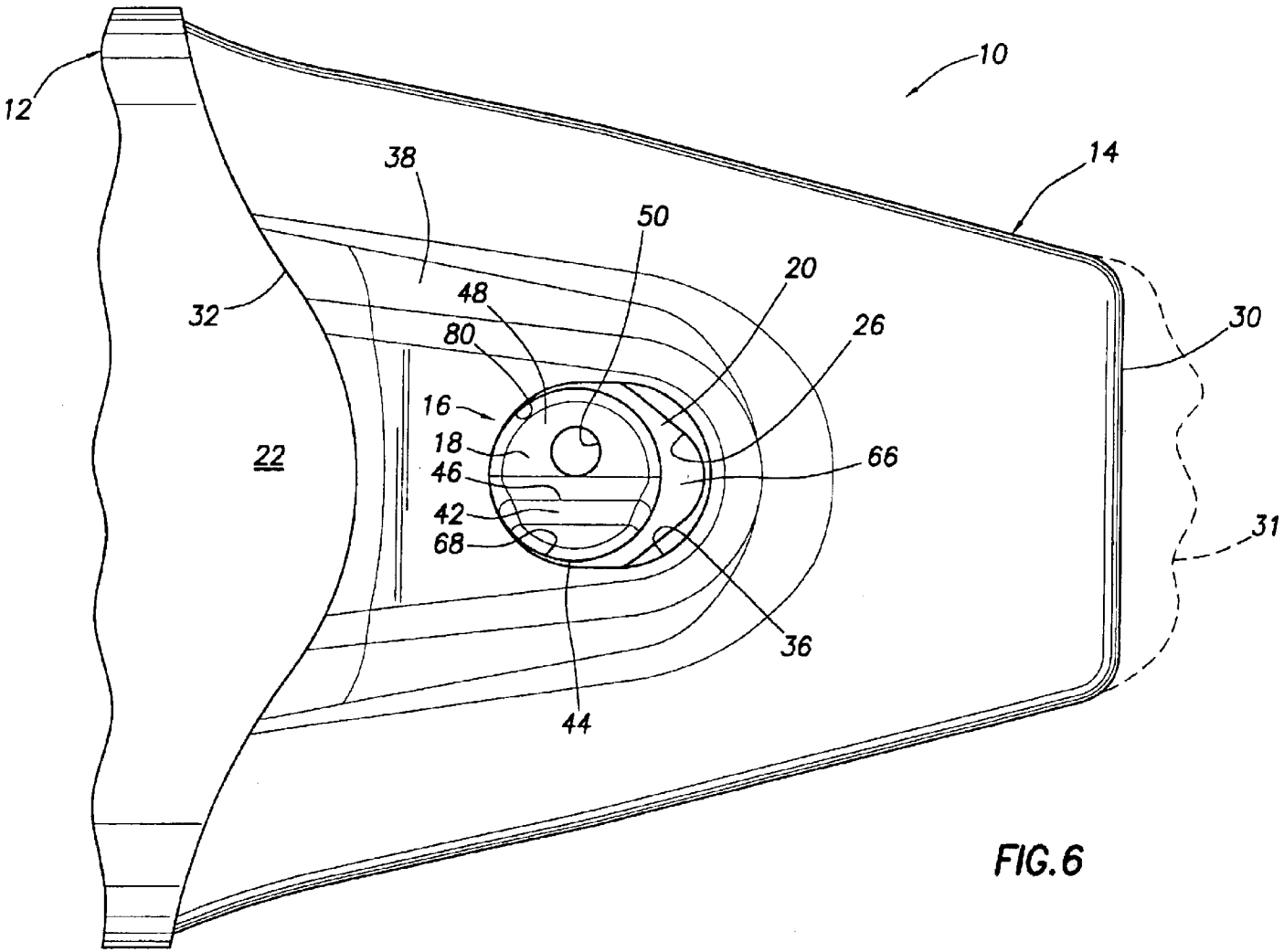
FIG. 6 is an enlarged scale side elevational view of the excavating tooth assembly, in an assembled state, with the connector pin being rotated to a release orientation thereof.
Figure 7:
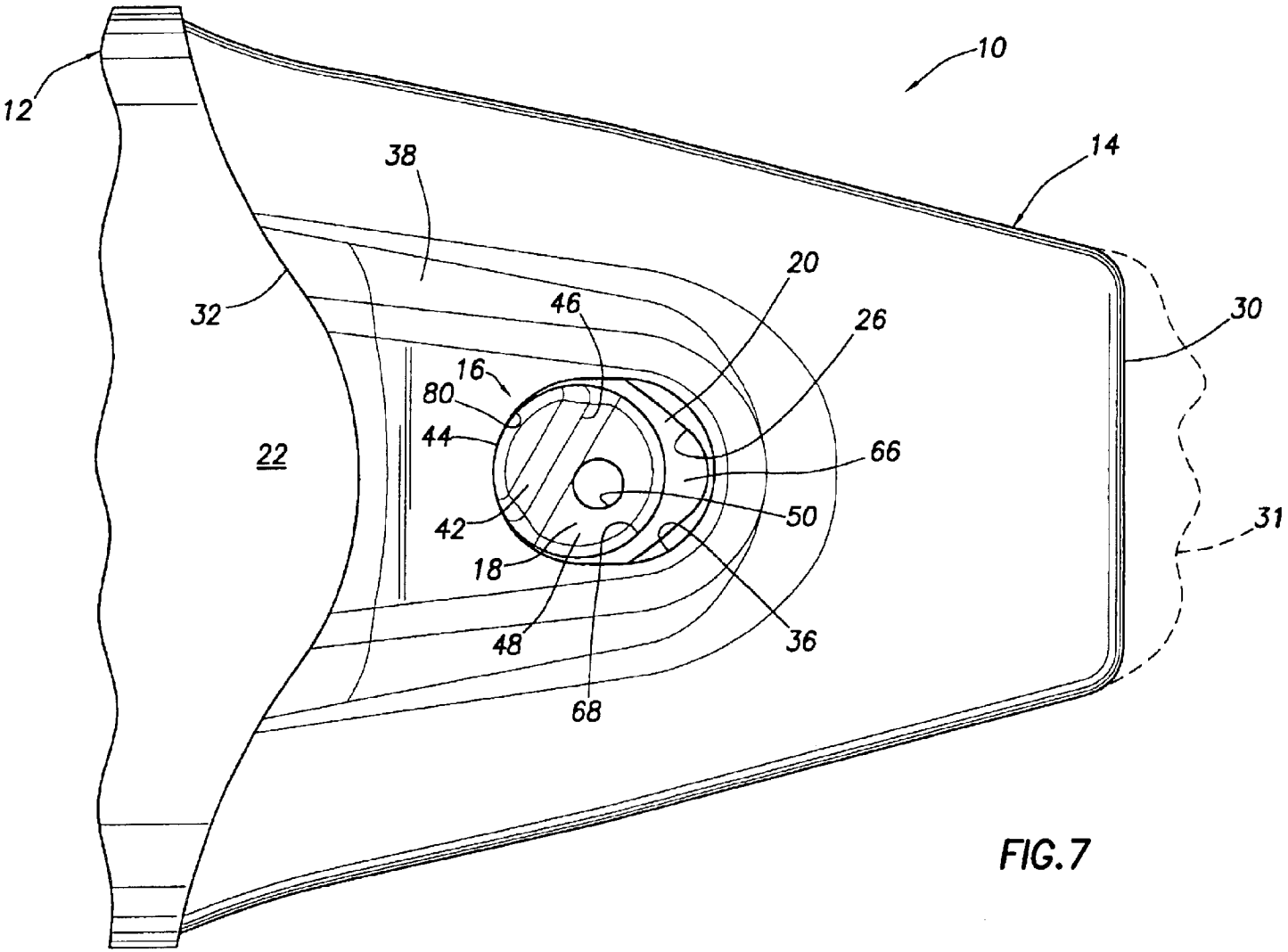
FIG. 7 is a view similar to that in FIG. 6, but with the connector pin being rotated to a locking orientation thereof.
Figure 8:
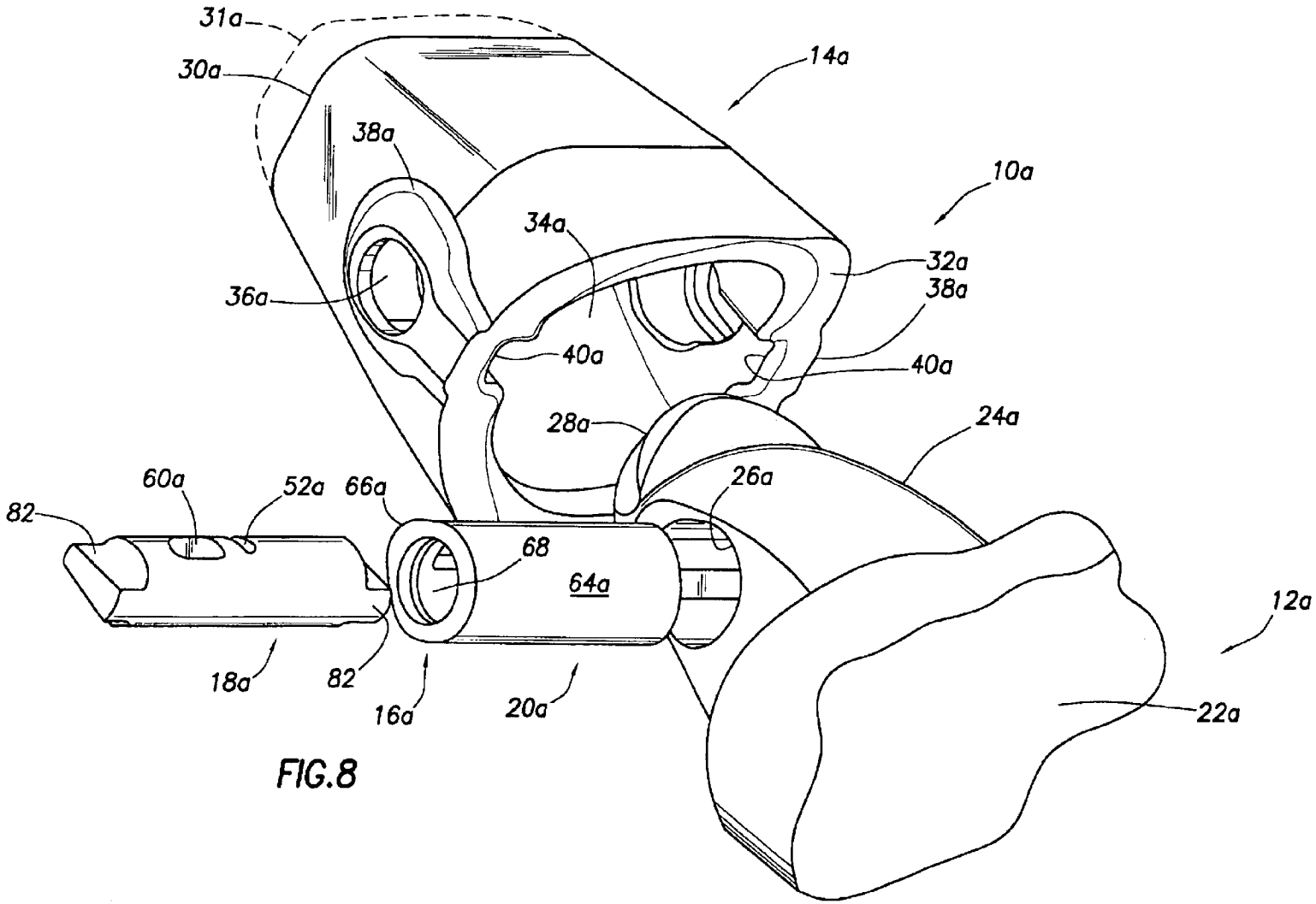
FIG. 8 is an exploded perspective view of a first alternate embodiment of the excavating tooth assembly.

To operatively install the replaceable tooth point 14 on the nose 24, the point 14 is simply slid rearwardly onto the nose 24 in a manner causing the outwardly projecting pin tabs 42 to forwardly traverse the opposed interior point recesses 40 until the ends of the pin 18 are brought into general alignment with the point openings 36, with the opposite pin end tabs 42 being in their rotational orientations shown in FIG. 6. Using a suitably configured tool (not shown), one end of the pin 18 is engaged and rotated to rotate the pin 18 through an arc of 120 degrees to its FIG. 7 orientation in which the curved outer side surfaces 44 of the pin tabs 42 complementarily engage upper rear interior side surface portions 80 of the point connector openings 36, thereby causing the now rotated pin tabs 42 to block forward removal of the installed point 14 from the adapter nose 24. Representatively, a tool used to effect this pin rotation could have an end portion with a flat side for contacting the flat side 46 of a pin tab 42, and a pin releasably receivable in the pin end opening 50. The pin 18 could then be forcibly rotated by correspondingly rotating the tool.

When the pin 18 is rotated to this locking orientation thereof, the pin detent 56 is removed from its associated cartridge recess 72, and the pin detent 62 snaps into its associated cartridge recess 74 to thereby resiliently inhibit the rotation of the pin 18 back to its FIG. 6 release position. To remove the point 14 from the adapter nose 24, the same tool is used to forcibly rotate the pin 18 from its FIG. 7 locking position to its FIG. 6 installation/release position to thereby permit the point 14 to be forwardly removed from the adapter nose in a manner causing the pin tabs 42 to rearwardly traverse and exit the point recesses 40. While two recesses 40 are representatively shown, it will be readily appreciated by those of ordinary skill in this particular art that a single recess 40 (in conjunction with a pin 18 having only one end portion extending outwardly beyond a side of the adapter nose 24) could be alternatively utilized if desired.

Figure 2:
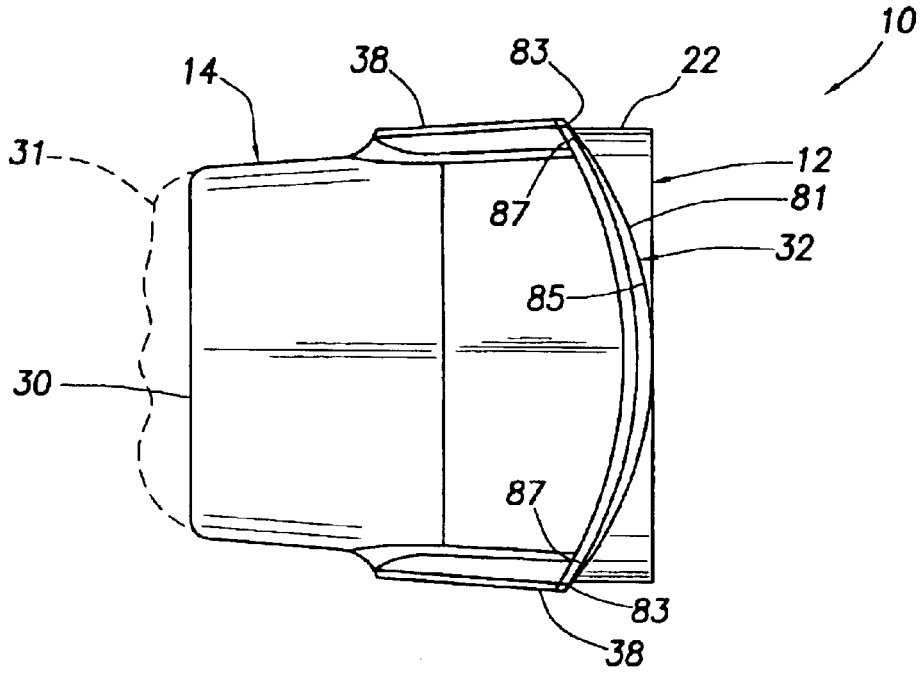
FIG. 2 is a reduced scale top plan view of the assembly in its assembled state.
Figure 3:
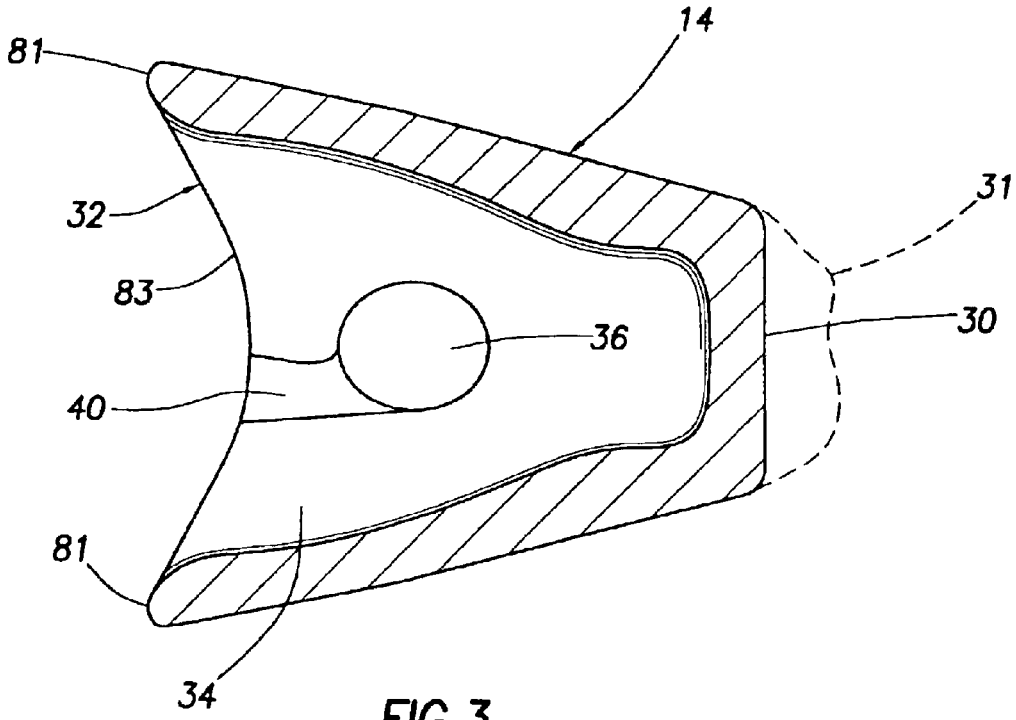
FIG. 3 is a reduced scale cross-sectional view through a replaceable point portion of the assembly taken along line 3—3 of FIG. 1.

As best illustrated in FIGS. 1–3, the rear end surface 32 of the point 14 has alternately scalloped portions extending around its periphery and defined by rearwardly convex arcuate top and bottom side sections 81, and forwardly concave arcuate left and right side sections 83. Similarly, the front side surface of the adapter base portion 22 has rearwardly concave top and bottom side sections 85 which are configured to be complementarily interlocked with the top and bottom point sections 81 when the point 14 is operatively mounted on the adapter nose 24, and forwardly convex left and right side sections 87 which are configured to be complementarily interlocked with the left and right point sections 83 when the point 14 is operatively mounted on the adapter nose 24.

A first alternate embodiment 10*a* of the previously described excavating tooth assembly 10 is shown in FIGS. 8–13. For ease in comparison of these two embodiments, components in the embodiment 10*a* similar to those in the embodiment 10 have been given the same reference numerals with the subscripts "a".

The excavating tooth assembly embodiment 10*a* is identical to the previously described embodiment 10 thereof with the following exceptions:

1. The pin 18*a* has, at its opposite ends, centrally disposed tapered tabs 82 in place of the off-center tabs 42 on the previously described pin 18 (see FIGS. 8 and 9), and the pin and cartridge detent structures are circumferentially spaced apart from one another by an arc of ninety degrees instead of 120 degrees;

2. The interior side surface recesses 40*a* of the tooth point 40*a* are vertically centered with respect to the point connector openings 36*a* (see FIGS. 8, 10 and 11); and 3. A pair of generally disc-shaped locking plugs 84 (see FIGS. 10 and 11) are rotatably disposed within inner portions of the point connector openings 36*a*, each plug 84 having (1) a noncircular driving opening 86 formed in its outer side, and (2) a tapered slot 88 (configured to complementarily receive one of the tapered pin end tabs 82) formed on its inner side. Each plug 84 is prevented from passing outwardly through its associated point opening 36*a* by a laterally inwardly facing ledge 90 (see FIG. 12) extending around the periphery of the associated point opening 36*a*.

Figure 9:
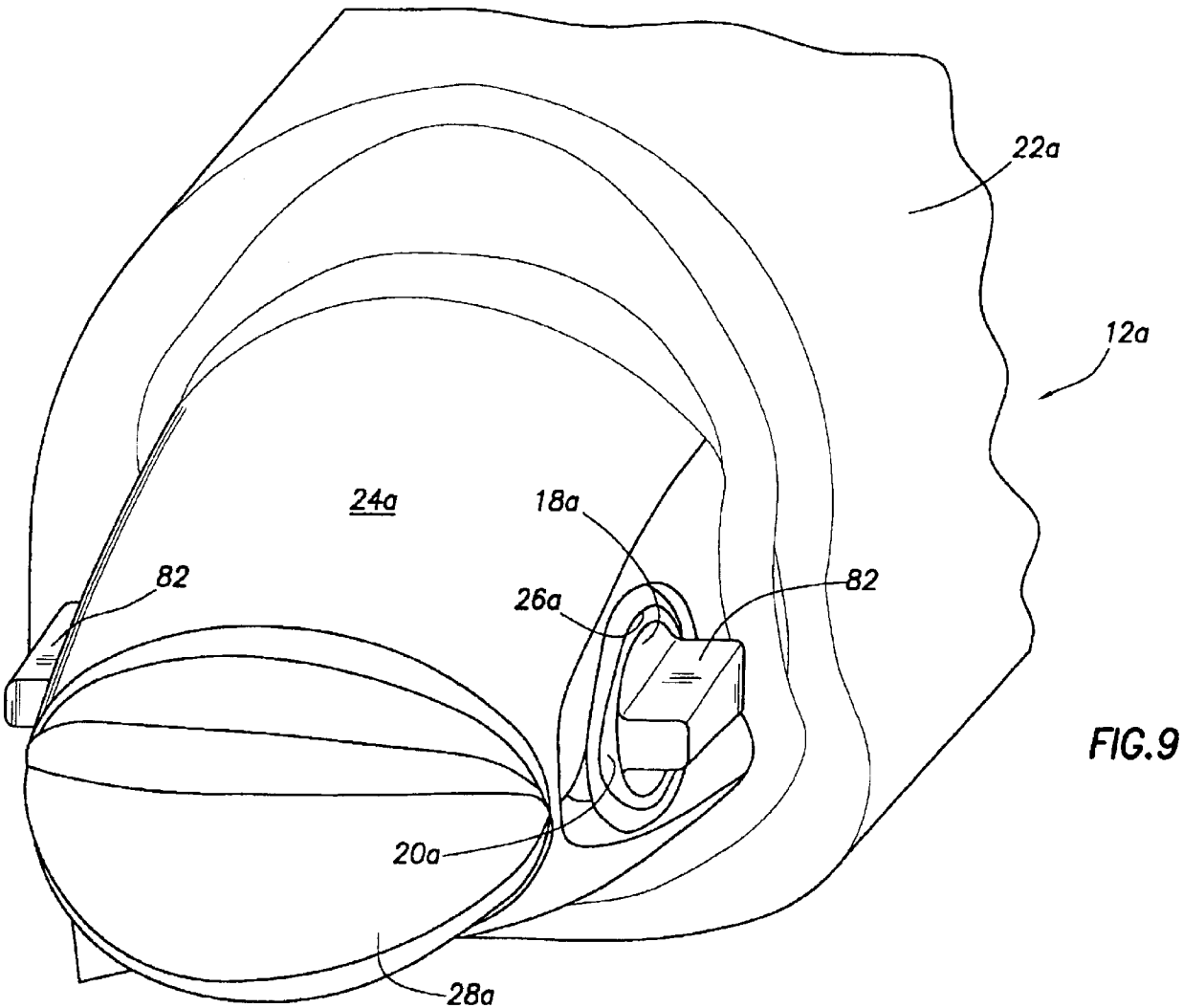
FIG. 9 is an enlarged scale front end perspective view of an adapter portion of the first alternate excavating tooth assembly embodiment, with the opposite ends of the connector pin being rotated to their release orientations.
Figure 10:
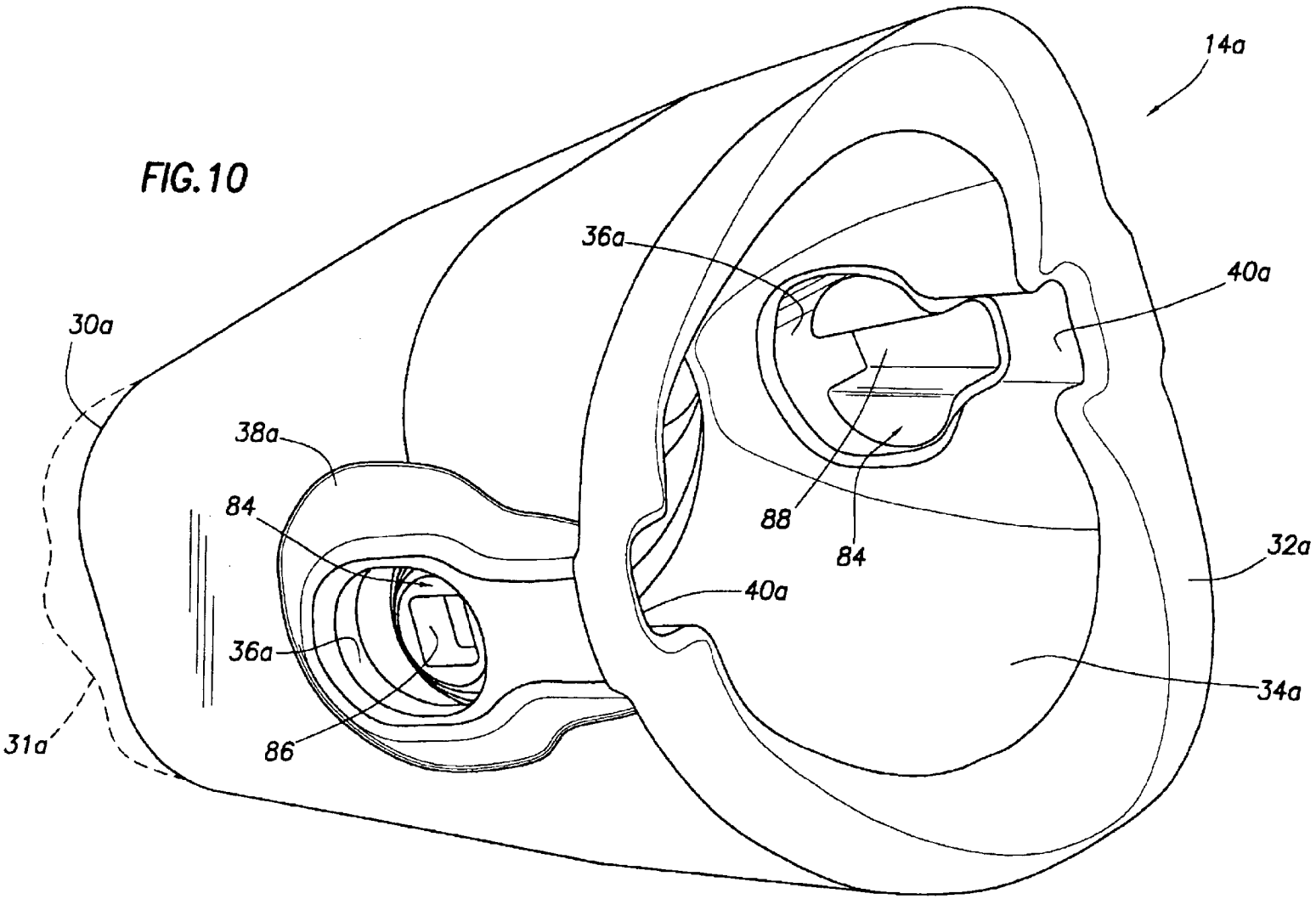
FIG. 10 is an enlarged scale rear end perspective view of the replaceable tooth point portion of the first alternate excavating tooth assembly embodiment.
Figure 11:
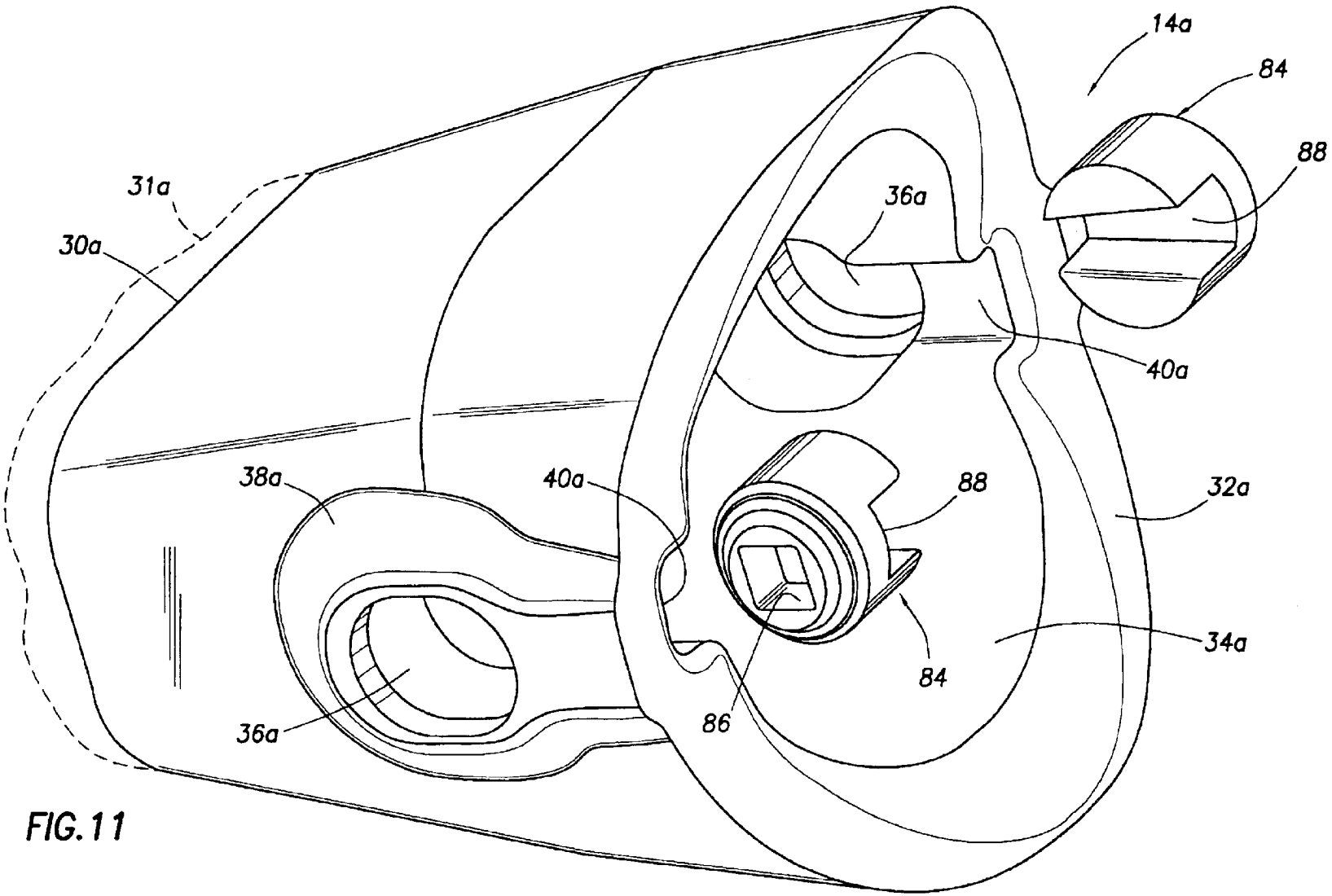
FIG. 11 is a view similar to that of FIG. 10, but with rotatable locking plug members being removed from the tooth point for illustrative purposes.
Figure 12:
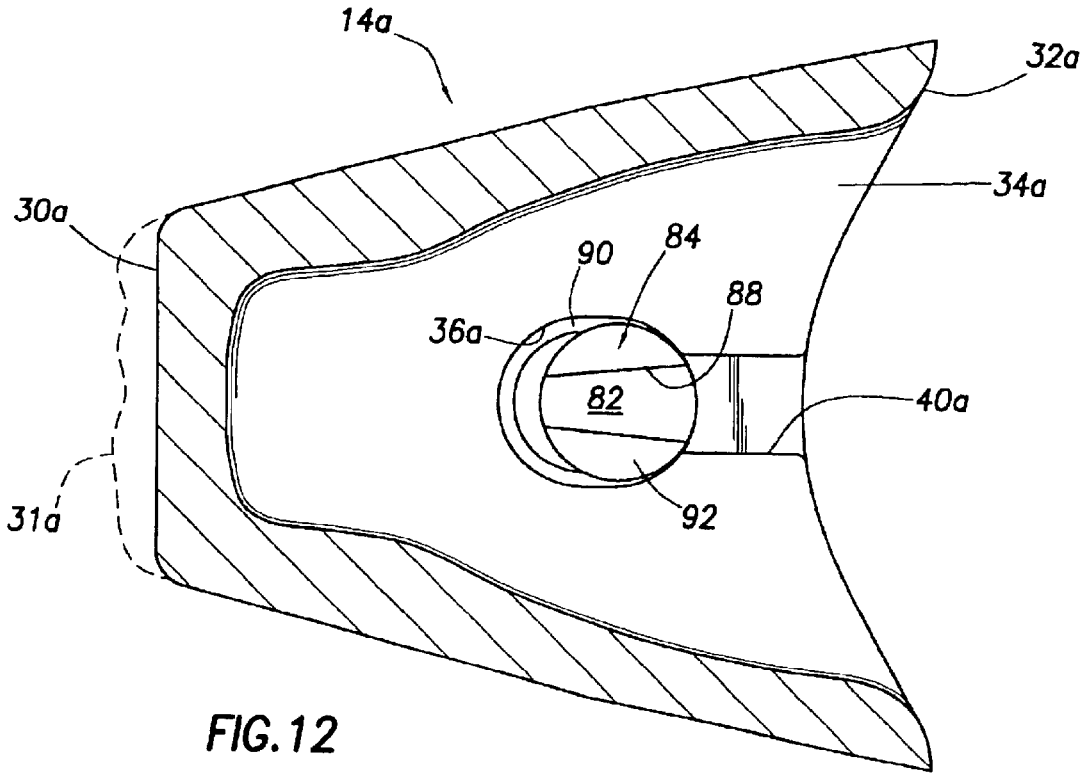
FIG. 12 is a somewhat simplified laterally directed cross-section through the FIG. 10 tooth point, with the locking plug members being rotated to their release orientations and receiving outer end portions of the rotatable connector pin.

With the plugs 84 rotationally supported within inner side portions of the point openings 36*a* and the plug slots 88 being horizontally oriented as shown in FIG. 10, and the pin 18*a* in its first detent orientation with the outwardly projecting pin tabs 82 being horizontally oriented as shown in FIG. 9, the point 14*a* is slid rearwardly onto the adapter nose 24*a* in a manner causing the point end tabs 82 to forwardly traverse the interior point side recesses 40*a* and complementarily enter the tapered plug slots 88 as schematically shown in FIG. 12.

Figure 13:
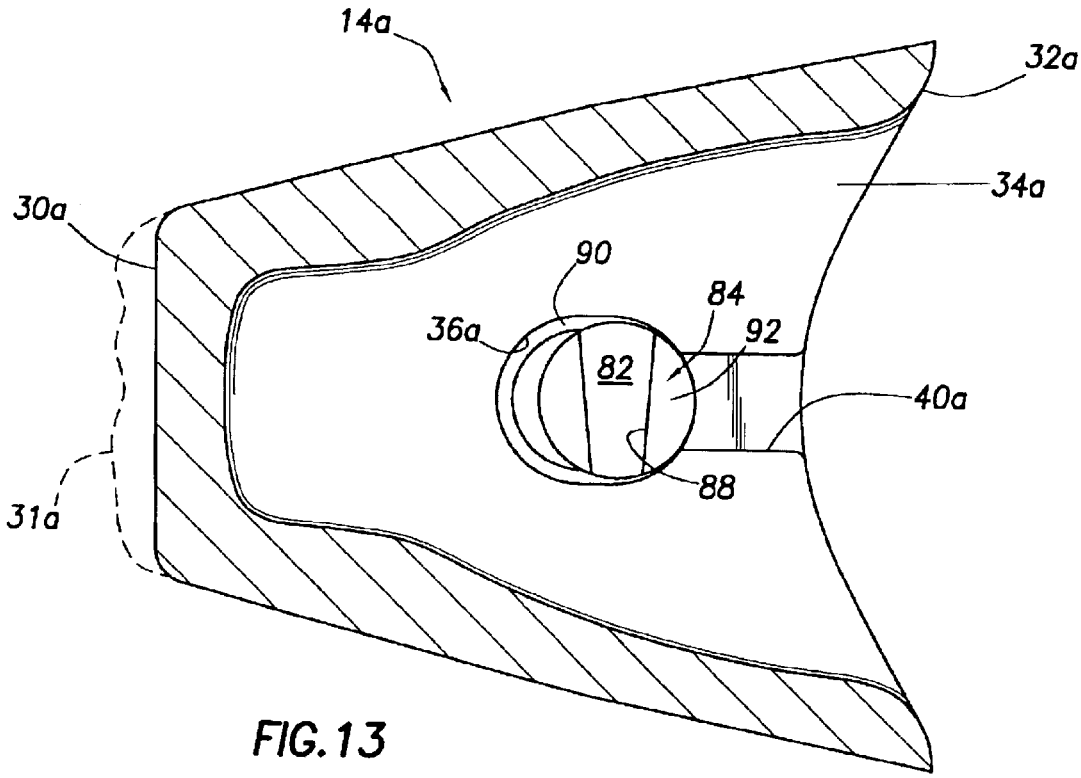
FIG. 13 is a view similar to that in FIG. 12, but with the plugs and connector pin ends being rotated to their locking orientations.

Next, a suitable tool is inserted into one of the noncircular (representatively square) plug openings 86 and used forcibly to rotate the associated plug 84 (and thus the other plug 84 and the pin 18*a*) 90 degrees to its locking orientation shown in FIG. 13. As can be seen in FIG. 13, with the plugs 84 and pin tabs 82 rotated to this locking orientation, side portions 92 of the plugs 84 block rearward movement of the pin tabs 82 through the point recesses 40*a*. Additionally, the outer end surface lengths of the pin tabs 82 are longer than the vertical heights of the point recesses 40*a*, thereby also blocking rearward movement of the pin tabs 82 rearwardly through the point recesses 40*a* and captively retaining the point 14*a* on the adapter nose 24*a*. To subsequently remove the point 14*a* from the adapter nose 24*a*, the plugs 84 are simply rotated back to their FIG. 12 orientations to permit the point 14*a* to be forwardly pulled off the adapter nose in a manner causing the pin end tabs 82 to be rearwardly pulled from the plug slots 88 and rearwardly traverse and exit the point recesses 40*a*.

Figure 14:
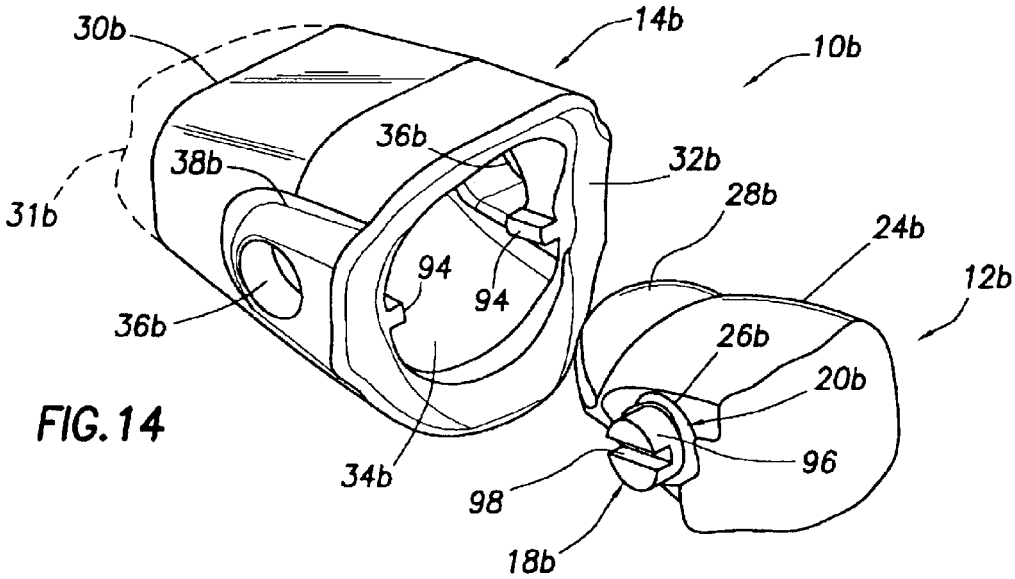
FIG. 14 is a simplified, somewhat schematic partially exploded perspective view of a second alternate embodiment of the excavating tooth assembly.
Figure 15:
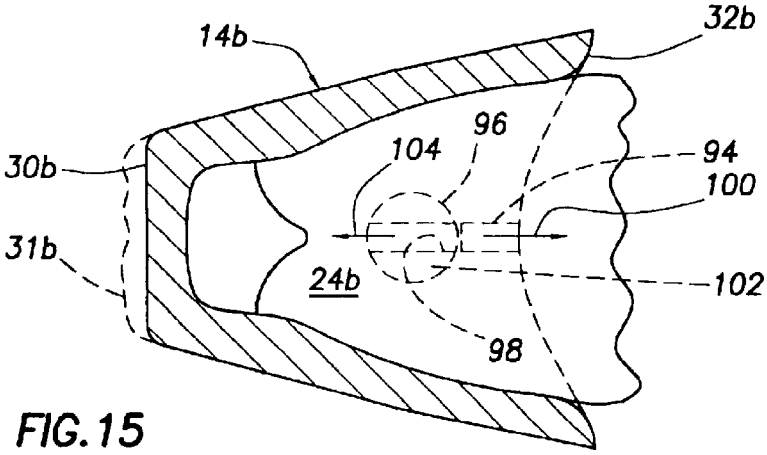
FIGS. 15 and 16 are simplified, somewhat schematic cross-sectional views through the second alternate excavating tooth assembly illustrating the manner in which the rotatable connector pin assembly is used to releasably and captively retain the tooth point portion of the excavating tooth assembly on the adapter nose portion thereof.
Figure 16:
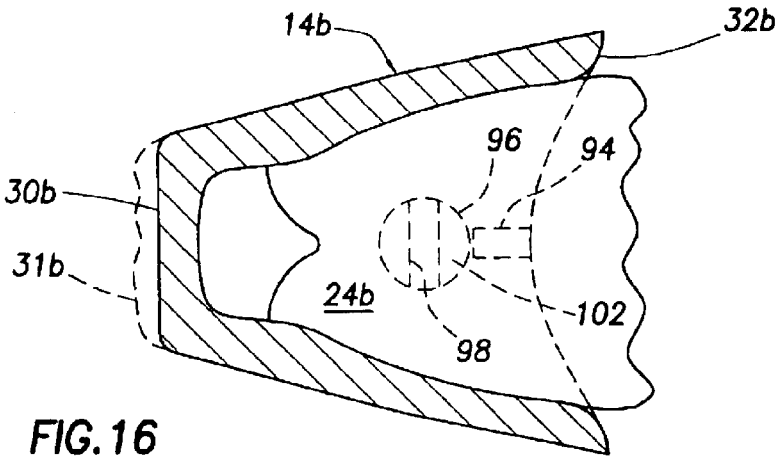

A second alternate embodiment 10*b* of the previously described excavating tooth assembly 10 is schematically illustrated in FIGS. 14–16. For ease in comparing the assembly embodiments 10 and 10*b*, components in the embodiment 10*b* similar to those in embodiment 10 have been given the same reference numerals to which the subscripts "b" have been added.

The excavating tooth assembly embodiment 10*b* is identical to the previously described embodiment 10 thereof with the following exceptions:

1. In the embodiment 10*b* of the excavating tooth assembly the interior point side surface recesses 40 in the point 10 are replaced with an opposing pair of inwardly projecting locking lugs 94 formed on the inner side surfaces of vertical side wall portions of the point 14*b* forwardly of the point openings 36*b* and in general vertical alignment therewith;

2. The pin ends 96 projecting outwardly beyond opposite vertical side surfaces of the adapter nose 24*b* have cylindrical shapes with notches 98 extending inwardly through their outer ends; and 3. The pin and cartridge detent structures are circumferentially spaced apart from one another by an arc of ninety degrees instead of 120 degrees.

With the pin 18*b* in its release/installation detent position as shown in FIG. 14, and the lengths of the pin end slots 98 in horizontal orientations, the point 14*b* is slid onto the adapter nose 24*b* to cause the point lugs 94 to pass rearwardly through the pin end slots 98 (as indicated by the arrow 100 in FIG. 15) to thereby position the point 94 lugs rearwardly of the slotted pin ends 96 and bring the pin ends 96 into inward alignment with the point openings 36*b*. A suitable tool is then inserted into one of the pin end slots 98 and rotated to forcibly rotate the pin 18*b* ninety degrees to its FIG. 16 locking detent position in which the lengths of the pin end slots 98 now extend vertically. This, in turn, causes side portions 102 of the pin ends 96 to block forward movement of the point lugs 94 past the pin ends 96 and thereby captively retain the point 14*b* on the adapter nose 24*b*.

To subsequently remove the point 14*b* from the adapter nose 24*b*, the pin 18*b* is simply rotated back to its FIG. 15 position to permit the point lugs 94 to pass forwardly through the pin end slots 98 (as indicated by the arrow 104 in FIG. 15) and forwardly free the point 14*b* from the adapter nose. As will be readily be appreciated by those of ordinary skill in this particular art, a single point lug 94 could be utilized, instead of the representatively depicted pair of lugs 94, if desired.

Figure 17:
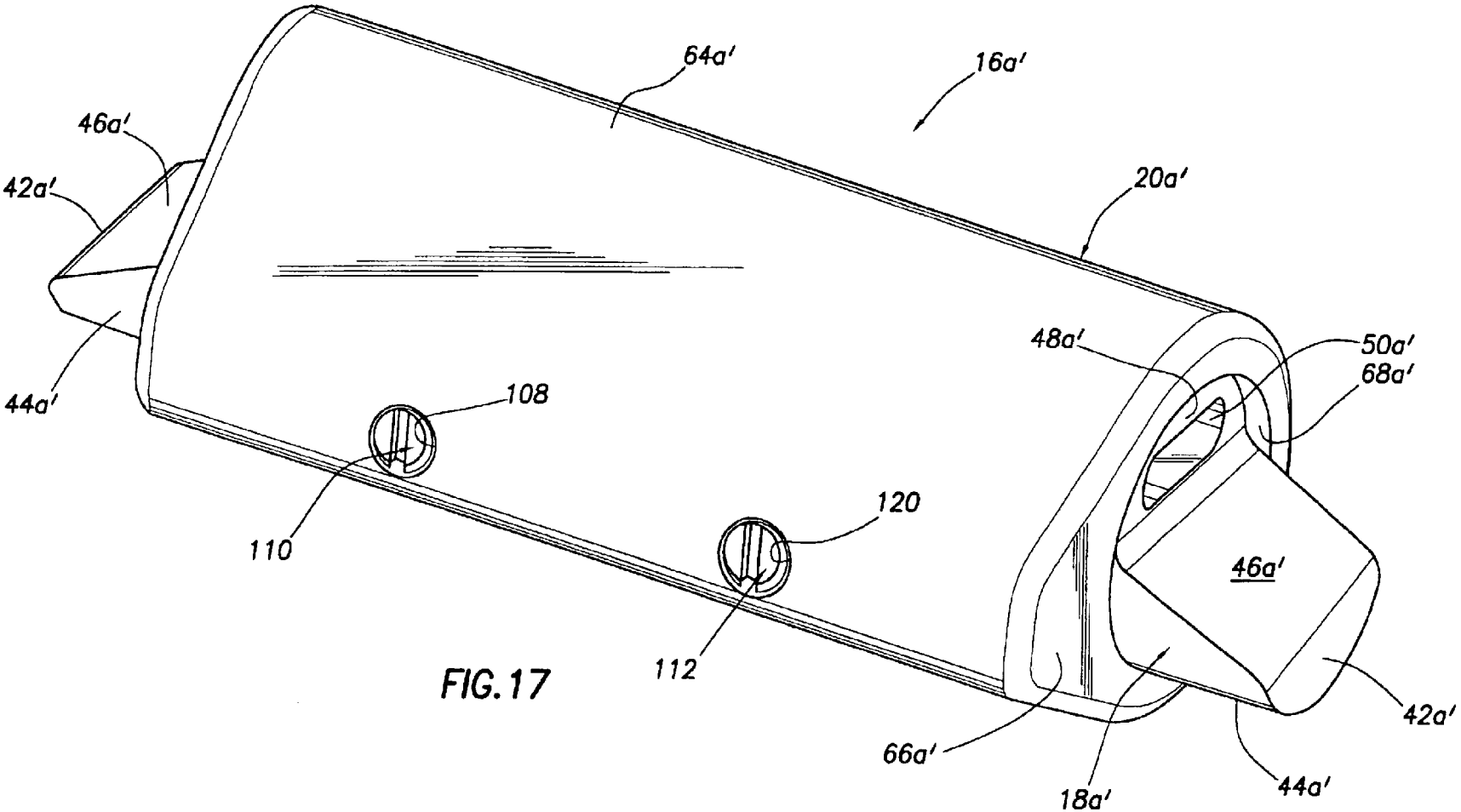
FIG. 17 is a perspective view of a first alternate embodiment of the connector pin assembly.
Figure 18:
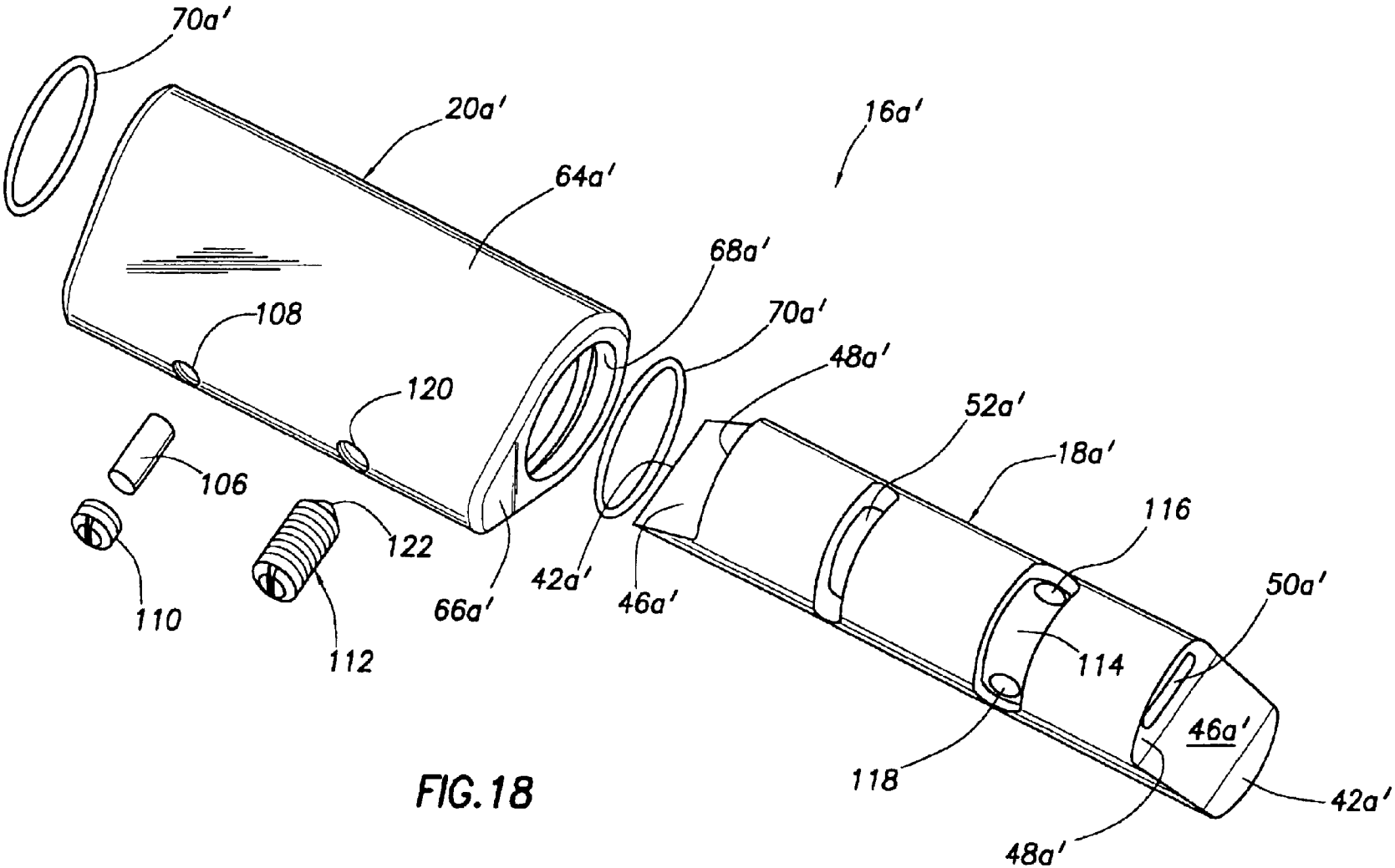
FIG. 18 is an exploded perspective view of the FIG. 17 connector pin assembly.

A first alternate embodiment 16*a*' of the previously described connector pin assembly 16 shown in FIGS. 1 and 4 is illustrated in FIGS. 17 and 18. For ease in comparison of these two embodiments, components in the embodiment 16*a*' similar to those in the embodiment 16 have been given the same reference numerals with the subscripts "a'".

The connector pin assembly 16*a*' shown in FIGS. 17 and 18 is similar to the previously described connector pin assembly 16, but has a somewhat different structure for permitting the pin 18*a*' to rotate relative to the cartridge 20*a*' without appreciably moving axially relative thereto, and a different detent structure which functions to releasably retain the pin 18*a*' in two different rotational orientations relative to the cartridge 20*a*'.

To permit the pin 18*a*' to rotate relative to the cartridge 20*a*' without axially moving relative thereto, a cylindrical dowel member 106 (see FIG. 18) is extended inwardly through a transverse threaded opening 108 in the cartridge lobe 66*a*' and has an inner end slidably received in the circumferentially extending exterior side groove 52*a*' of the pin 18*a*' in a manner precluding appreciable axial movement of the pin 18*a*' relative to the cartridge 20*a*', but permitting the pin 18*a*' to rotate relative to the cartridge 20*a*' through an arc determined by the circumferential distance between the opposite ends of the groove 52*a*'. The dowel 106 is captively retained within the lobe 66*a*' by a set screw 110 threaded into an outer end portion of the lobe opening 108.

The pin rotational detent structure incorporated in the connector pin assembly 16*a*' includes a conventional externally threaded spring plunger 112 and a circumferential exterior side surface groove 114 formed in the pin 18*a*' and having radially inwardly extending depressions 116,118. Spring plunger 112 is threaded into a transverse lobe opening 120 and has a resiliently depressible inner end portion 112 configured to snap into either of the groove end depressions 116,118 in response to the pin 18*a*' being rotated between its rotational limit positions. Between such limit positions the spring plunger end portion 122 is resiliently depressed by the inner side surface of the groove 114 between the end depressions 116 and 118, and when the spring plunger end portion 122 reaches either of such depressions it snaps into the depression.

While the end portions 42*a* of the pin 18*a*' are representatively similar to the end portions 42 in the pin 18 shown in FIGS. 1 and 4, so that the connector pin assembly 16*a*' can be used with the tooth point 14, it will be readily appreciated that the outer ends of the pin 18*a*' could be alternatively configured similar to the outer pin ends 82(see FIG. 8) or similar to the outer pin ends 96 (see FIG. 14) to respectively make the connector pin assembly 16*a*' useable with the tooth point 14*a* (see FIG. 8) and the tooth point 14*b* (see FIG. 14).

Figure 19:
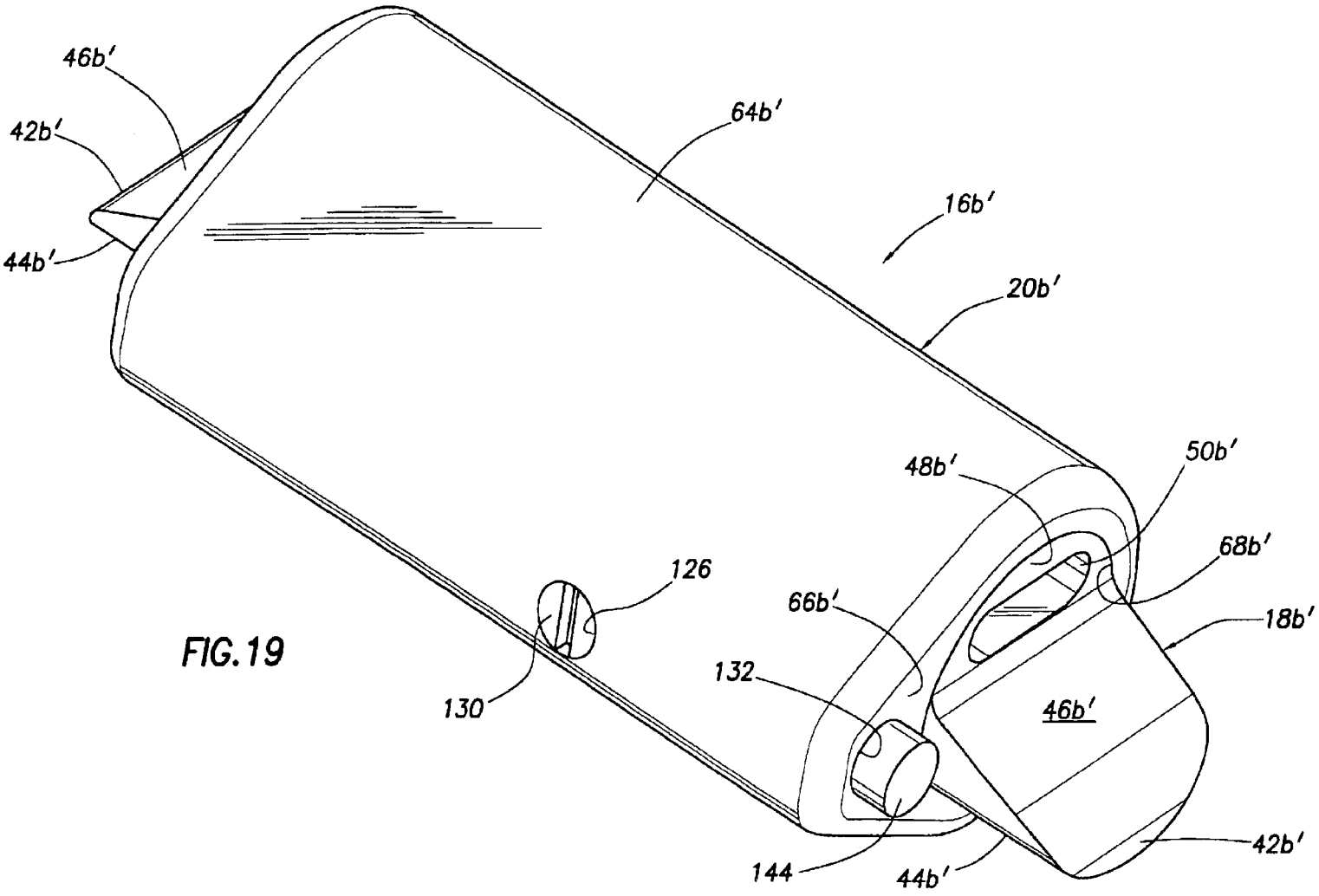
FIG. 19 is a perspective view of a second alternate embodiment of the connector pin assembly.
Figure 20:
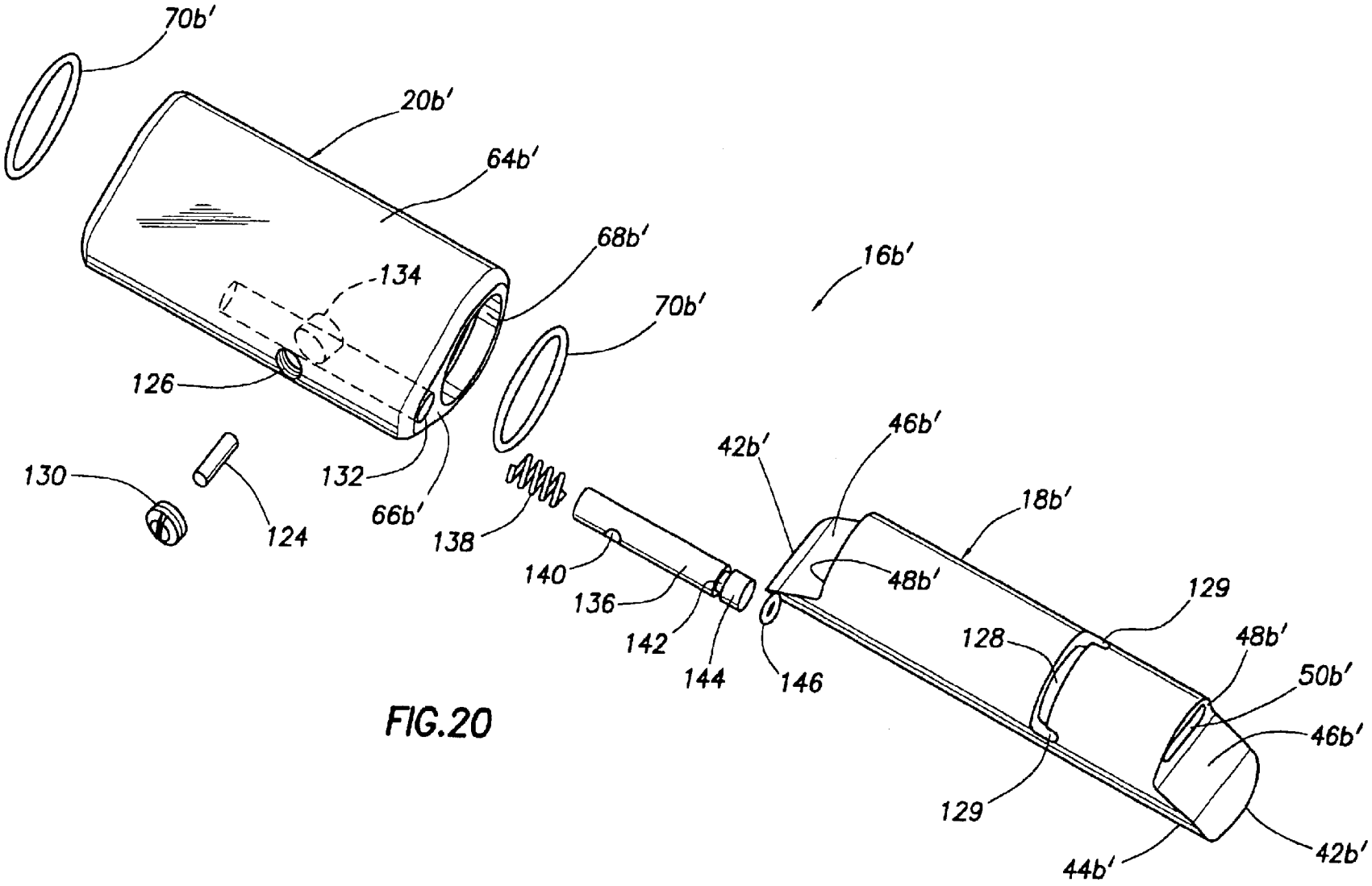
FIG. 20 is an exploded perspective view of the FIG. 19 connector pin assembly.

A second alternate embodiment 16*b*' of the previously described connector pin assembly 16 shown in FIGS. 1 and 4 is illustrated in FIGS. 19 and 20. For ease in comparison of these two embodiments, components in the embodiment 16*b*' similar to those in the embodiment 16 have been given the same reference numerals with the subscripts "b'".

The connector pin assembly 16*b*' shown in FIGS. 19 and 20 is similar to the previously described connector pin assembly 16, but has a somewhat different structure for permitting the pin 18*b*' to rotate relative to the cartridge 20*b*' without appreciably moving axially relative thereto, and a different detent structure which functions to releasably retain the pin 18*b*' in two different rotational orientations relative to the cartridge 20*b*'.

To permit the pin 18*b* to rotate relative to the cartridge 20*b*' without axially moving relative thereto, a cylindrical dowel member 124 (see FIG. 20) is extended inwardly through a transverse threaded opening 126 in the cartridge lobe 66*b*' and has an inner end slidably received in a circumferentially extending exterior side groove 128 of the pin 18*b*' in a manner precluding appreciable axial movement of the pin 18*b*' relative to the cartridge 20*b*', but permitting the pin 18*b*' to rotate relative to the cartridge 20*b*' through an arc determined by the circumferential distance between the circumferentially opposite ends of the groove 128. For purposes later described herein, the groove 128 has transversely extending opposite end portions 129. The dowel 124 is captively retained within the lobe 66*b*' by a set screw 130 threaded into an outer end portion of the lobe opening 126.

Extending longitudinally inwardly through the right end of the cartridge lobe 66*b*' (as viewed in FIGS. 19 and 20) is a circular bore 132 which is intersected on one side by the transverse opening 126 and intersected on the other side by a longitudinally elongated transverse passage 134 extending through the inner side surface of the cartridge opening 68*b*'. Slidably received within the bore 132 is a cylindrical locking rod 136 whose inner or left end bears against a coil spring member 138 captively retained within an inner end portion of the bore 132.

Inwardly adjacent the inner or left end of the rod 136 is a transverse circular bore 140 through which the dowel 124 extends, an inner end portion of the dowel 124 extending through the longitudinally elongated passage 134 and into the pin side groove 128. An annular exterior seal groove 142 is formed on the rod 136, inwardly adjacent an outer end portion 144 thereof, and receives a suitable O-ring seal member 146.

With the pin 18*b*' in one of its two rotational detent positions, the rod 136 is outwardly driven by the spring 138 in a manner positioning the inner end of the dowel 124 in a right end portion of one of the transverse portions 129 of the pin groove 128, thereby preventing the pin 18*b* from being rotated relative to the cartridge 20*b*' by, for example, operational forces being imposed on the overall tooth point/adapter assembly. In this position of the rod 136 the rod is prevented from moving further outwardly from the cartridge 20*b*' by an inner end portion of the dowel 124 which bears on a right side portion of the longitudinally elongated passage 134.

To rotate the pin 18*b*' to its other detent position, the outer end portion 144 of the locking rod 136 is pushed into the bore 132, against the resilient resistance of the spring 138, to thereby move the inner end of the dowel 124 through the pin groove end portion 129 that receives it and into alignment with the main circumferential portion of the pin groove 128. With the rod 136 held in this depressed orientation the pin 18*b*' is rotated relative to the cartridge 20*b*' until the inner end of the dowel 124 is brought to the opposite end of the pin groove 128 at which point the locking rod 136 is released. This permits the spring 138 to longitudinally drive the rod 136 back to its locking position in which the inner end of the dowel 124 is moved into the opposite transverse pin groove end portion 129 to thereby releasably lock the rotated pin 18*b*' in its other rotational detent position.

While the end portions 42*b*' of the pin 18*b*' are representatively similar to the end portions 42 in the pin 18 shown in FIGS. 1 and 4, so that the connector pin assembly 16*b*' can be used with the tooth point 14, it will be readily appreciated that the outer ends of the pin 18*b*' could be alternatively configured similar to the outer pin ends 82(see FIG. 8) or similar to the outer pin ends 96 (see FIG. 14) to respectively make the connector pin assembly 16*b*' useable with the tooth point 14*a* (see FIG. 8) and the tooth point 14*b* (see FIG. 14).

Figure 21:
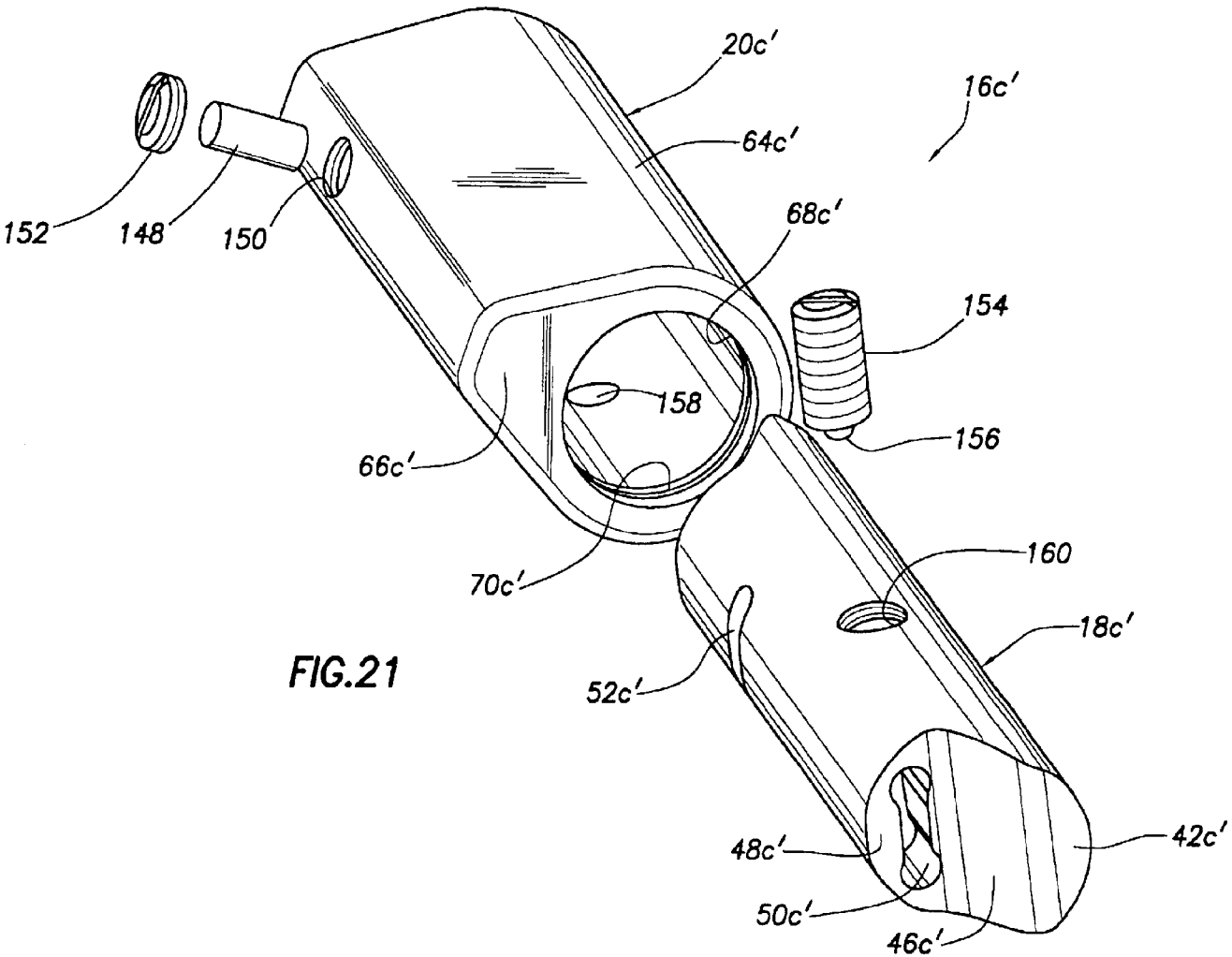
FIG. 21 is an exploded end and left side perspective view of a third alternate embodiment of the connector pin assembly.
Figure 22:
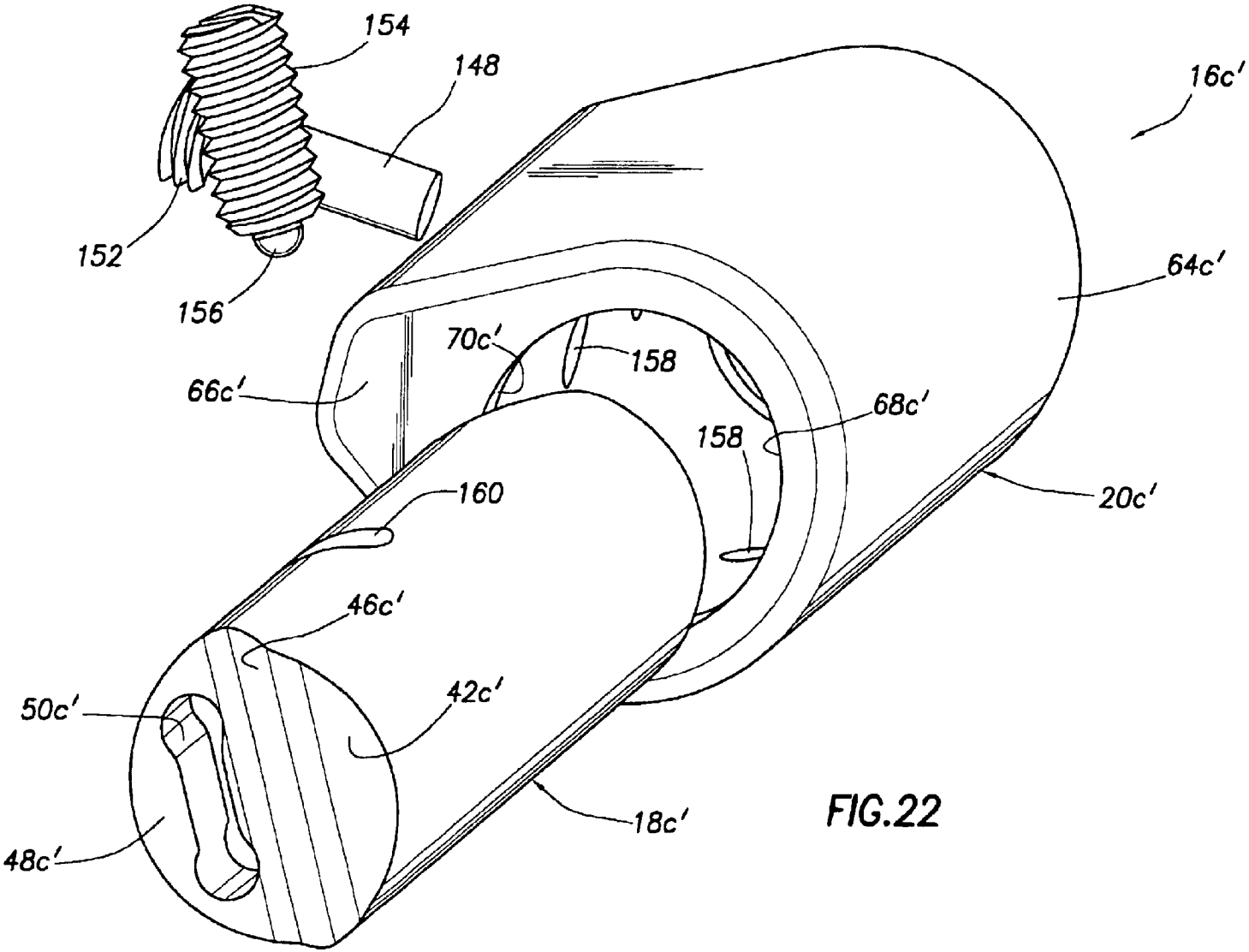
FIG. 22 is an exploded end and right side perspective view of the FIG. 21 connector pin assembly.
Figure 23:
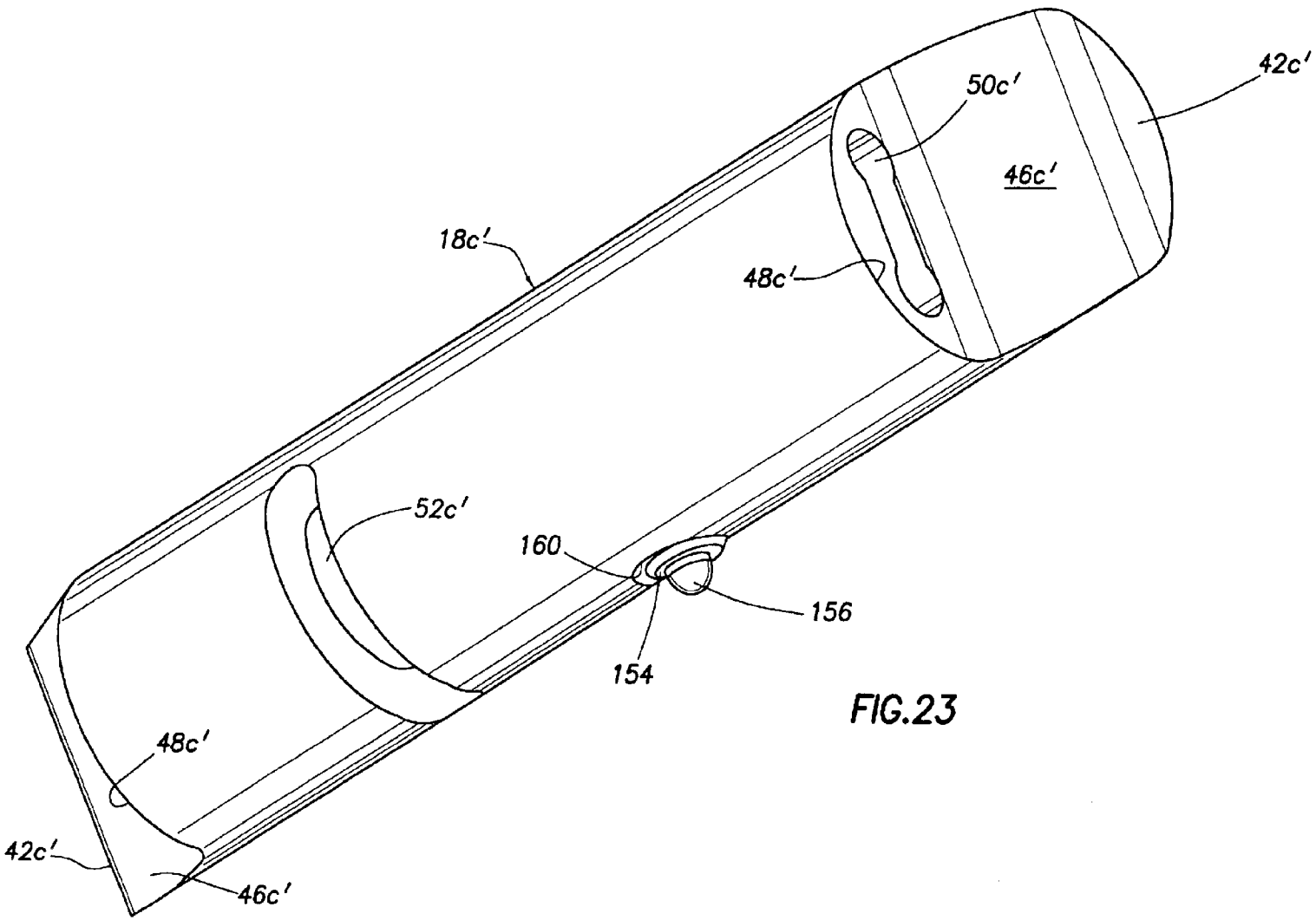
FIG. 23 is an assembled perspective view of the pin portion of the FIG. 21 connector pin assembly.

A third alternate embodiment 16*c*' of the previously described connector pin assembly 16 shown in FIGS. 1 and 4 is illustrated in FIGS. 21–23. For ease in comparison of these two embodiments, components in the embodiment 16*c*' similar to those in the embodiment 16 have been given the same reference numerals with the subscripts "c'".

The connector pin assembly 16*c*' shown in FIGS. 21–23 is similar to the previously described connector pin assembly 16, but has a somewhat different structure for permitting the pin 18*c*' to rotate relative to the cartridge 20*c*' without appreciably moving axially relative thereto, and a different detent structure which functions to releasably retain the pin 18*c*' in two different rotational orientations relative to the cartridge 20*c*'.

To permit the pin 18*c*' to rotate relative to the cartridge 20*c*' without axially moving relative thereto, a cylindrical dowel member 148 (see FIGS. 21 and 22) is extended inwardly through a transverse threaded opening 150 in the cartridge lobe 66*c*' and has an inner end slidably received in the circumferentially extending exterior side groove 52*c*' of the pin 18*c* in a manner precluding appreciable axial movement of the pin 18*c*' relative to the cartridge 20*c*', but permitting the pin 18*c*' to rotate relative to the cartridge 20*c*' through an arc determined by the circumferential distance between the opposite ends of the groove 52*c*'. The dowel 148 is captively retained within the lobe 66*c* by a set screw 152 threaded into an outer end portion of the lobe opening 150.

The pin rotational detent structure incorporated in the connector pin assembly 16*c*' includes a conventional externally threaded spring plunger 154 having a resiliently depressible end portion 156, and a circumferentially spaced pair of detent recesses 158 formed in the interior side surface of the cartridge 20*c*'. The spring plunger 154 is threaded into a threaded transverse hole 160 extending through the pin 18*c*', in a longitudinally spaced apart relationship with the pin groove 52*c*, with the depressible end portion 156 of the spring plunger 154 projecting outwardly from a side of the pin 18*c*' as illustrated in FIG. 23.

When the pin 18*c*' is operatively installed in the cartridge 20*c*' and rotated to one of its two rotational detent positions, the depressible spring plunger portion 156 snaps into one of the interior cartridge detent recesses 158. Subsequent rotation of the pin 18*c*' to its other detent position cams the depressible spring plunger end portion 156 out of its original detent depression, thereby causing the now depressed end portion 156 to slide along the interior side surface of the cartridge 18*c*' until the pin reaches its second detent position and the spring plunger end portion 156 snaps into the other detent depression 158.

While the end portions 42*c*' of the pin 18*c*' are representatively similar to the end portions 42 in the pin 18 shown in FIGS. 1 and 4, so that the connector pin assembly 16*c*' can be used with the tooth point 14, it will be readily appreciated that the outer ends of the pin 18*c*' could be alternatively configured similar to the outer pin ends 82(see FIG. 8) or similar to the outer pin ends 96 (see FIG. 14) to respectively make the connector pin assembly 16*c* useable with the tooth point 14*a* (see FIG. 8) and the tooth point 14*b* (see FIG. 14).

As can be seen, the representative embodiments 10, 10*a* and 10*b* of the excavating tooth assembly of the present invention are adapted to utilize representatively depicted connector pin assemblies which, compared to excavating tooth point/adapter connector structures of design, provide a variety of advantages including, but not limited to, simplicity of construction, reliability, ruggedness, and ease of use. Particularly advantageous is the ability of the representatively illustrated connector pin assemblies to remain in their associated adapter nose as the tooth point is either removed from the nose or installed thereon. While the present invention is representatively utilized in conjunction with a tooth point which is releasably mounted on an adapter, it also may be used to advantage with other wear member/support structure combinations such as, for example, an intermediate adapter releasably mounted on a main adapter.

The foregoing detailed description is to be clearly understood as being given by way of illustration and example only, the spirit and scope of the present invention being limited solely by the appended claims.

What is claimed is:

1. Excavating apparatus comprising:

a support structure having a projecting portion onto which a wear member may be placed to shield said projecting portion from wear, said projecting portion having an exterior side surface through which a connector opening inwardly extends; and a connector structure carried by said projecting portion of said support structure and operative to releasably retain the wear member on said projection portion, said connector structure including:

a hollow body extending along an axis and being axially and nonrotatably received in said connector opening, said hollow body having an outer end through which a pin opening axially extends, a connector pin member having a cylindrical body portion coaxially received in said pin opening, and an outer end portion projecting outwardly beyond said outer end of said hollow body and said exterior side surface of said projecting portion of said support structure, said outer end of said connector pin member having, with respect to said cylindrical body portion, a laterally reduced cross-section, and first cooperating structures associated with said hollow body and said connector pin member and functioning to permit rotation of said connector pin member relative to said hollow body about said axis, but preclude appreciable axial movement of said connector pin member relative to said hollow body.

2. The excavating apparatus of claim 1 wherein:

said support structure is an adapter, and said projecting portion is a nose portion of said adapter.

3. The excavating apparatus of claim 2 wherein:

said nose portion has an elliptical cross-section.

4. The excavating apparatus of claim 1 wherein:

said hollow body and said connector opening have non-circular cross-sections along their axial lengths.

5. The excavating apparatus of claim 4 wherein:

said hollow body has a generally cylindrical configuration with a lateral lobe extending along a side portion thereof.

6. The excavating apparatus of claim 1 wherein:

said outer end portion of said connector pin member is laterally offset from said axis of said cylindrical body portion of said connector pin member.

7. The excavating apparatus of claim 4 wherein:

said outer end portion of said connector pin member has a first side portion defining an axially outward extension of the outer side surface of said cylindrical body portion of said connector pin member, and a second side portion extending generally chordwise relative to said cylindrical body portion of said connector pin member.

8. The excavating apparatus of claim 7 wherein:

said connector pin member has an axially facing end surface disposed at the inner termination of said outer end portion of said connector pin member and having a drive opening extending axially inwardly therethrough.

9. The excavating apparatus of claim 1 wherein:

said outer end portion of said connector pin member is defined by a diametrically extending tab projecting longitudinally outwardly from said cylindrical body portion of said connector pin member.

10. The excavating apparatus of claim 9 wherein:

said tab has a tapered configuration.

11. The excavating apparatus of claim 1 wherein:

said outer end portion of said connector pin member has a notch extending generally diametrically therethrough between opposite side surface portions thereof.

12. The excavating apparatus of claim 1 wherein said first cooperating structures include:

a circumferentially extending groove formed in an exterior side surface portion of said cylindrical body portion of said connector pin member, and a laterally inwardly projecting member carried by said hollow body and received in said groove.

13. The excavating apparatus of claim 12 wherein:

said laterally inwardly projecting member is a set screw.

14. The excavating apparatus of claim 12 wherein:

said laterally inwardly projecting member is a dowel.

15. The excavating apparatus of claim 1 further comprising:

second cooperating structures associated with said hollow body and said connector pin member and functioning to releasably hold said connector pin member in first and second separate rotational orientations thereof relative to said hollow body member.

16. The excavating apparatus of claim 15 wherein said second cooperating structures include:

first and second spaced apart recesses formed in one of said hollow body member and said connector pin member, and a resiliently depressible detent structure carried by the other of said hollow body and said connector pin member and being releasably receivable in a selectively variable one of said first and second spaced apart recesses.

17. The excavating apparatus of claim 16 wherein:

said first and second spaced apart recesses have ramped configurations.

18. The excavating apparatus of claim 16 wherein:

said first and second spaced apart recesses are formed in interior side surface portions of said hollow body which are axially spaced apart from one another and generally circumferentially aligned with one another, and said resiliently depressible detent structure is carried by said cylindrical body portion and includes first and second resiliently depressible detent members axially and circumferentially spaced apart from one another.

19. The excavating apparatus of claim 15 wherein said second cooperating structures include:

a circumferentially extending groove formed in an exterior side surface portion of said cylindrical body portion of said connector pin member and having opposite end depressions, and a detent member transversely carried by said hollow body and having a resiliently depressible inner end portion extending into said groove and adapted to slide along said groove as said pin member is rotated relative to said hollow body and snap into either of said end recesses when reaching the groove end associated therewith.

20. The excavating apparatus of claim 19 wherein:

said detent member is a spring plunger transversely threaded into said hollow body.

21. The excavating apparatus of claim 15 wherein said second cooperating structures include:

a circumferentially extending groove formed in an exterior side surface portion of said cylindrical body portion of said connector pin member and having opposite end portions extending in a first direction parallel to the length of said connector pin member, a detent member carried by said hollow body for movement relative thereto parallel to the length of said connector pin member between first and second limit positions, said detent member having a portion thereof slidably received in said groove, and a spring member resiliently biasing said detent member in said first direction toward one of said first and second limit positions.

22. The excavating apparatus of claim 21 wherein said second cooperating structures further include:

a longitudinal opening formed in said hollow body laterally outwardly of said connector pin member, and a locking rod member slidably received in said longitudinal bore and having an outer end portion projecting outwardly from an end of said hollow body, said locking rod member being outwardly biased by said spring structure and having a transverse opening through which said detent member extends, said detent member being movable with said locking rod member in said first direction relative to said hollow body.

23. The excavating apparatus of claim 15 wherein said second cooperating structures include:

a detent member carried by said connector pin member and having a resiliently depressible end portion projecting outwardly beyond an exterior side surface of said connector pin, and first and second circumferentially spaced apart depressions formed the interior side surface of said hollow body, and into which said detent member end portion may resiliently snap into as said connector pin member is rotated relative to said hollow body.

24. The excavating apparatus of claim 23 wherein:

said detent member is a spring plunger transversely threaded into said connector pin member.

25. Excavating apparatus comprising:

a support structure having a projecting portion extending lengthwise in a forward direction and having an exterior surface portion through which a connector opening inwardly extends in a direction generally transverse to said forward direction;

a wear member having a cavity forwardly and releasably receiving said projecting portion of said support structure and having a rear end disposed rearwardly of said connector opening; and a connector pin longitudinally extending into said connector opening and having a longitudinal portion extending outwardly beyond said exterior surface portion of said projecting portion of said support structure, said connector pin being supported for rotation relative to said projecting portion of said support structure, without appreciable axial movement relative thereto, between (1) a first rotational position in which said outwardly extending longitudinal portion of said connector pin blocks forward removal of said wear member from said projecting portion of said support structure, and (2) a second rotational position in which said outwardly extending longitudinal portion of said connector pin no longer blocks, and thus permits, forward removal of said wear member from said projecting portion of said support structure.

26. The excavating apparatus of claim 25 wherein:

said support structure is an adapter, said projecting portion of said support structure is a nose portion of said adapter, and said wear member is a replaceable tooth point.

27. The excavating apparatus of claim 25 further comprising:

a detent structure operative to releasably hold said connector pin in either selected one of said first and second rotational positions thereof.

28. The excavating apparatus of claim 25 wherein:

said excavating apparatus further comprises a hollow body nonrotatably received in said connector opening, said connector pin is rotatably received in said hollow body, and said excavating apparatus further comprises cooperating structures associated with said hollow body and said connector pin and operative to preclude appreciable axial movement of said connector pin relative to said hollow body.

29. The excavating apparatus of claim 25 wherein:

said wear member has an interior side surface recess area through which said outwardly extending longitudinal portion of said connector pin may be forwardly moved into and rearwardly moved out of said wear member, said recess area having an abutment area that cooperates with said outwardly extending longitudinal portion of said connector pin, when said connector pin is in said first rotational position thereof, to block forward removal of said wear member from said projecting portion of said support structure.

30. The excavating apparatus of claim 25 wherein:

said wear member has a locking portion rotatable with said outwardly extending longitudinal portion of said connector pin between locking and unlocking positions in which said locking portion respectively (1) defines an abutment surface, when said connector pin is in said first rotational position thereof, that captively retains said outwardly extending longitudinal portion of said connector pin within said wear member, and (2) releases said outwardly extending longitudinal portion of said connector pin when said connector pin is in said second rotational position thereof.

31. The excavating apparatus of claim 25 wherein:

said wear member has an interior side surface projection thereon which, with said connector pin in said first rotational position thereof, defines an abutment cooperating with said outwardly extending longitudinal portion of said connector pin to prevent removal of said wear member from said projecting portion of said support structure and, said outwardly extending longitudinal portion of said connector pin being configured in a manner such that, with said connector pin in said second rotational position thereof, permits said interior side surface projection to be moved forwardly past said outwardly extending longitudinal portion of said connector pin.

32. The excavating apparatus of claim 25 wherein:

said support structure has a rear base portion with a front end surface from which said projecting portion forwardly extends, said front end surface having an alternately scalloped configuration.

33. The excavating apparatus of claim 32 wherein:

said alternately scalloped configuration is defined by peripherally alternating forwardly and rearwardly curved portions of said front end surface of said rear base portion.

34. The excavating apparatus of claim 25 wherein:

said support structure has a rear base portion with a front end from which said projecting portion of said support structure extends, and said front end of said rear base portion of said support structure and said rear end of said wear member are alternately scalloped in front-to-rear directions and are in a complementarily interlocked relationship.

35. The excavating apparatus of claim 34 wherein:

said front end of said rear base portion of said support structure and said rear end of said wear member have peripherally alternating forwardly and rearwardly curved portions.

* * * * *